US006536543B2

(12) United States Patent
Meiners et al.

(10) Patent No.: US 6,536,543 B2
(45) Date of Patent: Mar. 25, 2003

(54) ROTARY DRILL BITS EXHIBITING SEQUENCES OF SUBSTANTIALLY CONTINUOUSLY VARIABLE CUTTER BACKRAKE ANGLES

(75) Inventors: Matthew J. Meiners, The Woodlands, TX (US); Jeffrey B. Lund, The Woodlands, TX (US); Thomas M. Harris, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/730,983

(22) Filed: Dec. 6, 2000

(65) Prior Publication Data

US 2002/0066601 A1 Jun. 6, 2002

(51) Int. Cl.[7] ..... E21B 10/16; E21B 10/52
(52) U.S. Cl. ..... 175/431; 175/336
(58) Field of Search ..... 175/331, 336, 175/428, 431

(56) References Cited

U.S. PATENT DOCUMENTS

| | | | | | |
|---|---|---|---|---|---|
| 4,342,368 | A | | 8/1982 | Denman | |
| 4,660,659 | A | | 4/1987 | Short, Jr. et al. | |
| 5,178,222 | A | * | 1/1993 | Jones et al. | 175/398 |
| 5,314,033 | A | | 5/1994 | Tibbitts | |
| 5,377,773 | A | | 1/1995 | Tibbitts | |
| 5,443,565 | A | | 8/1995 | Strange, Jr. | |
| 5,549,171 | A | | 8/1996 | Mensa-Wilmot et al. | |
| 5,551,522 | A | * | 9/1996 | Keith et al. | 175/420.2 |
| 5,582,261 | A | * | 12/1996 | Keith et al. | 175/431 |
| 5,592,996 | A | * | 1/1997 | Keith et al. | 175/430 |
| 5,607,024 | A | * | 3/1997 | Keith et al. | 175/431 |
| 5,607,025 | A | * | 3/1997 | Mensa-Wilmot et al. | 175/431 |
| 5,649,604 | A | * | 7/1997 | Fuller et al. | 175/431 |
| 5,803,196 | A | * | 9/1998 | Fielder | 175/431 |
| 5,816,346 | A | * | 10/1998 | Beaton | 175/431 |
| 5,937,958 | A | | 8/1999 | Mensa-Wilmot et al. | |
| 5,960,896 | A | | 10/1999 | Barr et al. | |
| 5,967,247 | A | | 10/1999 | Pessier | |
| 5,979,576 | A | | 11/1999 | Hansen et al. | |
| 5,979,577 | A | * | 11/1999 | Fielder | 175/431 |
| 6,021,859 | A | * | 2/2000 | Tibbitts et al. | 175/431 |
| 6,039,131 | A | | 3/2000 | Beaton | |
| 6,065,553 | A | * | 5/2000 | Taylor | 175/428 |
| 6,112,836 | A | | 9/2000 | Spaar et al. | |
| 6,123,161 | A | * | 9/2000 | Taylor | 175/397 |
| 6,164,394 | A | * | 12/2000 | Mensa-Wilmot et al. | 175/331 |
| 6,173,797 | B1 | * | 1/2001 | Dykstra et al. | 175/325.2 |
| 6,230,828 | B1 | * | 5/2001 | Beuershausen et al. | 175/431 |
| 6,298,930 | B1 | * | 10/2001 | Sinor et al. | 175/428 |
| 6,308,790 | B1 | * | 10/2001 | Mensa-Wilmot et al. | 175/398 |
| 6,321,862 | B1 | * | 11/2001 | Beuershausen et al. | 175/393 |
| 2001/0000885 | A1 | * | 5/2001 | Beuershausen et al. | 175/408 |
| 2001/0020551 | A1 | * | 9/2001 | Taylor et al. | 175/57 |
| 2001/0030065 | A1 | * | 10/2001 | Beuershausen et al. | 175/327 |

* cited by examiner

*Primary Examiner*—David Bagnell
*Assistant Examiner*—Jennifer H Gay
(74) *Attorney, Agent, or Firm*—TraskBritt

(57) ABSTRACT

A rotary-type earth-boring drag bit with cutters oriented at varied rake angles and methods for designing such drag bits. Specifically, cutters that are located sequentially adjacent radial distances from a longitudinal axis of the drill bit have cutting faces that are oriented at rake angles that differ from one another. These cutters may be located on the same blade of the drag bit or on different blades of the drag bit. The rake angles at which the cutting faces of these cutters are oriented may be based, at least in part, on the relative radial distances these cutters are spaced from the longitudinal axis of the drag bit, on the vertical positions of these cutters along the longitudinal axis of the drag bit, or in response to actual or simulated evaluations of the use of the drag bit to drill a subterranean formation.

46 Claims, 28 Drawing Sheets

ROTARY DRILL BITS EXHIBITING SEQUENCES OF SUBSTANTIALLY CONTINUOUSLY VARIABLE CUTTER BACKRAKE ANGLES

BACKGROUND OF THE INVENTION

1. Field of the Invention

The present invention relates generally to rotary bits for drilling subterranean formations. More specifically, the invention relates to fixed cutter, or so-called "drag" bits, employing superabrasive cutters exhibiting continuously varying cutter backrake angles along different locations or zones on the face of the bit, the variations being tailored to improve the transition between portions of the bit which may contain different cutter backrake angles as well as optimize the performance of the drill bit.

2. State of the Art

Conventional rotary-type earth-boring drill bits typically include cutting elements, or "cutters", arranged thereon so as to facilitate the cutting away of a subterranean formation in a desired manner. Cutters, typically including polycrystalline diamond compacts (PDCs), are oriented in cutter pockets of the bit, which are oriented so as to protect the cutter and provide clearance at the trailing edge of the cutter as it moves axially while drilling. The angle at which a cutting face of a cutter is oriented relative to a wall of a bore hole being formed is referred to as "rake". If the angle between a bore hole surface and a cutter face is 90°, the rake is said to be neutral, or zero degrees. If the angle between the cutting face of a cutter and the adjacent surface of the bore hole being formed is less than 90°, the rake angle is negative, and is typically termed "backrake". The amount of backrake is equal to the angle the cutting face of the cutter is tilted from the neutral rake position. For example, a cutter oriented with its cutting face at a 70° angle to the adjacent surface of the bore hole being formed has a 20° backrake (90°−70°=20°). When the rake angle between the cutting face of a cutter and the adjacent bore hole surface is greater than 90°, the cutter is oriented with a positive, or aggressive, rake angle, or a "frontrake", which is measured in a similar manner to that in which backrake is measured.

Recent laboratory testing and modeling have demonstrated that cutter backrake angles may affect drilling performance characteristics. Specifically, increasing the backrake angle of a cutter appears to improve drilling performance after the cutter begins to wear. The wear flat of a cutter oriented at a larger backrake angle is smaller than the wear flat of a cutter oriented at a smaller (i.e., closer to neutral) backrake angle for a given amount of diamond volume removed. This means that as the diamond begins to wear away from the cutter, cutters oriented at larger backrake angles have smaller "flat" areas than do cutters oriented at smaller backrake angles. Smaller wear flats on cutters essentially provide a more effective cutting geometry. A sharp cutter (i.e., small wear flat) contacts a formation with less area and the same amount of force, thereby inducing larger stresses in the formation, increasing cutting efficiency. In addition, it has been found that orienting cutters to have larger backrake angles does not detrimentally affect the performance of the bit as cutter wear increases. Moreover, cutters that are oriented to have larger backrake angles typically provide better impact resistance than cutters that are oriented to have smaller backrake angles.

Although the aforementioned increased impact resistance and advantageous wear flat behavior is beneficial, the detriment to large backrake angles is that more weight on bit (WOB) is required to drill at a given rate of penetration (ROP). Therefore, generally, an all-encompassing increase in cutter backrake angles may cause the drill bit to require such a great WOB so as to render the bit undrillable.

Cutter rake not only affects the relationship between the ROP and the WOB but also determines the aggressiveness of the bit. Thus, the rakes of the cutters on a drag bit can affect the performance and drilling characteristics of the bit. The cutters on many drag bits are oriented so as to be backraked due to the increased fracture resistance of cutters with relatively large backrakes.

Current PDC drag bit design typically includes cutters oriented at different backrake angles depending upon their locations upon the bit. For example, cutters that are located within about a third of the bit radius from the bit's longitudinal axis are typically oriented with nominal 15° backrake angles. Cutters located in the shoulder area of the bit are oriented with backrake angles of about 20°. Cutters that are positioned near the gage section of the bit are typically oriented so as to have even higher backrake angles, for instance, about 30°. This discontinuous change in cutter backrake angle abruptly changes cutter behavior and performance between each area of the bit. This discontinuity may be exaggerated by the effective rake angles of the cutters.

Each cutter located on a bit crown at a given radial distance from the longitudinal axis of the bit will traverse a helical path upon rotation of the bit. The geometry (pitch) of the helical path is determined by the ROP of the bit (i.e., the rate at which the bit drills into a formation) and the rotational speed of the bit. Mathematically, it can be shown that the helical angle traversed by a cutter relative to a horizontal plane (i.e., a plane normal to the longitudinal axis of the bit) depends upon the distance the cutter is spaced apart from the longitudinal axis of the bit. For a given ROP and rotary speed, cutters located closer to the longitudinal axis have greater helical angles than those of cutters positioned greater distances from the longitudinal axis of the bit. Essentially, the greatest change in helical angles occurs for cutters positioned about 1½ inches to about 2 inches from the bit's longitudinal axis. In this region, the helical angles of the cutters during rotation of the bit vary from near 90° for cutters nearest the longitudinal axis of the bit to about 7° for cutters positioned about 2 inches from the longitudinal axis. The change in helical angle for cutters spaced about 2 inches from the longitudinal axis up to the bit gage is relatively small.

Effective cutter backrake is the angle between the cutter and the formation after correcting for the aforementioned helical angle during drilling (i.e., subtracting the helical angle of a cutter during drilling from the rake angle of the cutter). Since cutters may be at different radial locations, their cutting speeds will vary linearly with their radial position. This phenomenon of variance in "effective rake" of a cutter with radial location, bit rotational speed, and ROP is known in the art and a more detailed discussion thereof may be found in U.S. Pat. No. 5,377,773, assigned to the assignee of the present invention, the disclosure of which is hereby incorporated herein in its entirety by this reference.

Planar state of the art PDCs, as well as thermally stable products (TSPs) and other known types of cutters, are typically set at a given backrake angle on the bit face to enhance their ability to withstand axial loading of the bit, which is caused predominantly by the downward force applied to the bit during drilling, WOB. By comparing the effective backrake of a cutter, it is easy to see that cutters positioned within about 2 inches of the longitudinal axis of a bit are angled more aggressively than more distantly positioned cutters with the same or similar actual backrake angles.

As a result of the different effective rake angles of cutters that are oriented on a bit so as to have the same actual rake angles, these cutters wear differently, depending upon their radial distances from the longitudinal axis of the bit. Attempts have been made to correct for this problem through cutter redundancy, but the effectiveness of cutter redundancies is limited by the number of blades on the bit and by space constraints.

U.S. Pat. No. 5,979,576 to Hansen t al. (hereinafter "Hansen"), assigned to the assignee of the present invention, discloses anti-whirl drag bits with "flank" cutters placed in a so-called "cutter-devoid zone" at or near the gage area thereof. Typically, a bearing pad would be positioned on the bit in this region, and would accept the imbalance force, thereby keeping the bit stable. Instead, it is proposed in Hansen to place cutters located within the normally cutter-devoid area at a lesser height from the bit profile than other cutters and at positive, neutral, or negative rake angles. These cutters only engage the formation when the cutting zone cutters dull and the bit has a reduced tendency to whirl, or when the cutting zone cutters achieve relatively high depths of cut, such as when reaming or under high rates of penetration. Under high depths of cut, these cutters engage the formation and prevent damage to the bearing zone and thereby extend the life of the anti-whirl drag bit. While Hansen discloses flank cutters oriented at specific angles, Hansen does not disclose orienting the flank cutters on a bit at different rake angles from one another.

U.S. Pat. No. 5,549,171 to Mensa-Wilmot et al. discloses drag bits with sets of cutters which are generally spaced the same radial distance from the longitudinal axis of the bit position but have differing backrakes. This may be accomplished by placing cutters with different backrakes onto different blades of the drag bit. Each set of cutters includes cutters oriented at the same rake angles. The cutters of different sets on a single blade may each have the same rake angles, or longitudinally adjacent sets of cutters offset, with a single blade of the bit including cutters oriented at different rake angles. The different rake angles of the cutters on each blade are not, however, angles that vary continuously (i.e., increase or decrease) along the height of the drag bit or with various radial distances from a longitudinal axis of the drag bit.

U.S. Pat. No. 5,314,033 to Tibbitts (hereinafter "Tibbitts"), assigned to the assignee of the present invention, discloses the use of "positive"-raked cutters in combination with negative or neutral rake cutters in such a manner that the cutters work cooperatively with one another. Effectively positive raked cutters are disclosed as aggressively initiating the cutting of the formation, whereas effectively negative raked cutters are disclosed as skating or riding on the formation. This causes two vastly different cutting mechanisms to coincide on the drill bit, with sudden changes at the coincident boundary between areas with different effective backrakes. Tibbitts does not, however, disclose a bit that includes regions on the face thereof with cutters oriented at different, continuously varying positive or negative rake angles.

The inventors are not aware of any art that discloses drag bits with fixed cutters at a particular region of the bit that are oriented so as to have different, continuously varied rake angles.

BRIEF SUMMARY OF THE INVENTION

The present invention includes rotary drag bits with fixed cutters having substantially continuously varied rake angles corresponding to the locations of the cutters relative to the longitudinal axis of the drag bit. As used herein, the term "rake" refers to the radial angle of a cutting face of a cutter relative to a reference line perpendicular to a surface of a formation being drilled, as described previously herein.

In one embodiment of a drag bit incorporating teachings of the present invention, cutters are oriented to have rake angles that increase proportionately with an increase of the radial distance of cutter locations from the longitudinal axis of the drag bit.

In another embodiment of the present invention, a drag bit includes a face with a plurality of radially separate cutter zones or regions thereon. Each cutter zone includes a number of cutters oriented so as to have the same backrake angle. The cutters of one zone on the face of the drag bit will, however, be oriented to have rake angles that differ from the cutters located within the one or more other zones on the face of the drag bit. In regions where two adjacent zones border one another, cutters adjacent to the border are oriented so as to have rake angles that provide a smooth transition between the rake angles of cutters in each of the adjacent zones. In addition, a given zone or region may include a sequence of cutters having increasing, decreasing, increasing then decreasing, decreasing then increasing, or cyclical variations in rake angles.

Another embodiment of drag bit according to the present invention also includes fixed cutters with at least a region or zone over the bit face which are oriented to have rake angles that vary continuously, but not necessarily proportionately to the radial distance of each of the cutters from the longitudinal axis of the drag bit. Rather, other factors, such as the longitudinal location or the angle of the helical path of each cutter, may be taken into account in determining the rake angle at which each of the cutters is oriented.

A drag bit incorporating teachings of the present invention may include at least three cutters oriented so as to have rake angles that increase or decrease sequentially based upon the relative radial locations of the cutters on the drag bit, the relative longitudinal positions of the cutters on the drag bit, or the relative positions of the cutters on a blade of the drag bit.

The rake angles of cutters on drag bits of the present invention may take into account the angle of the helical path each cutter travels during rotation of the drag bit. The angle of the helical path may be accounted for by continuously varying the effective rake angles of the cutters depending upon their position on the drag bit so as to counteract the effective rakes of the cutters caused by the angles of the helical paths of the cutters.

It is also contemplated that the rake angles of different cutters may be varied in response to bit performance factors. By way of example, weight on bit as a function of torque data may be analyzed and cutters within at least one region on the face of a drag bit may be oriented at rake angles that are continuously varied so as to provide a torque response as a function of weight on bit. As another example, the rake angles at which different cutters within a particular region of a face of a drag bit are oriented may be selected in response to bit stability data. Directional drilling criteria may also be used to determine the different, continuously varied rake angles of cutters within a particular region on a face of a drag bit. Other examples of factors that may be considered to determine the specific, continuously varied rake angle of different cutters on a face of a drag bit include, but are not limited to, wear characteristics, formation type, cutter loading, rock stresses, filtration and filtration gradients versus design depth of cut in permeable rocks, and thermal loading.

Other features and advantages of the present invention will become apparent to those of ordinary skill in the art through consideration of the ensuing description, the accompanying drawings, and the appended claims.

DETAILED DESCRIPTION OF THE PREFERRED EMBODIMENTS

Figure 1:
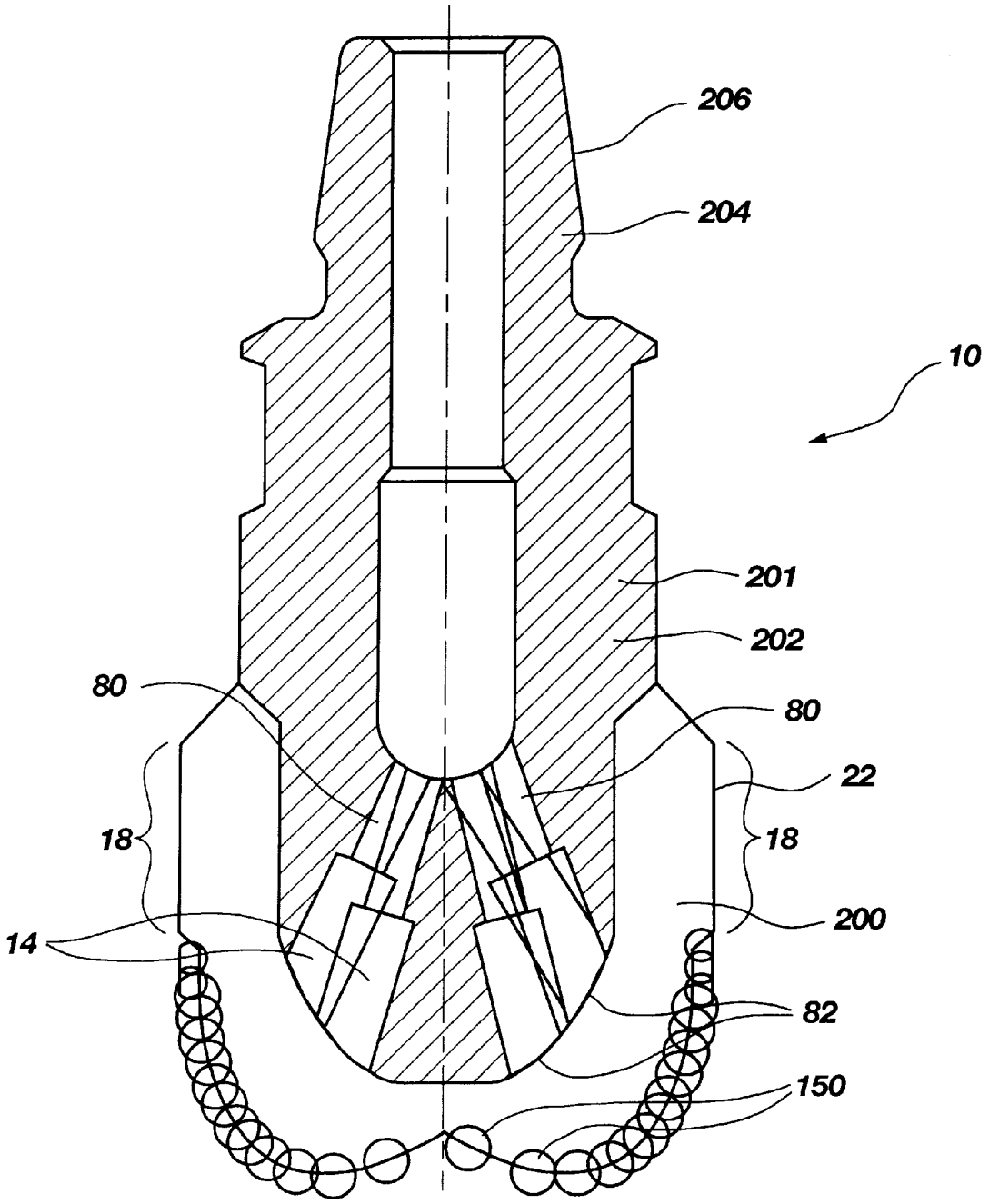
FIG. 1 is a side cross-sectional elevation of a five-bladed earth-boring rotary-type drag bit.
Figure 2:
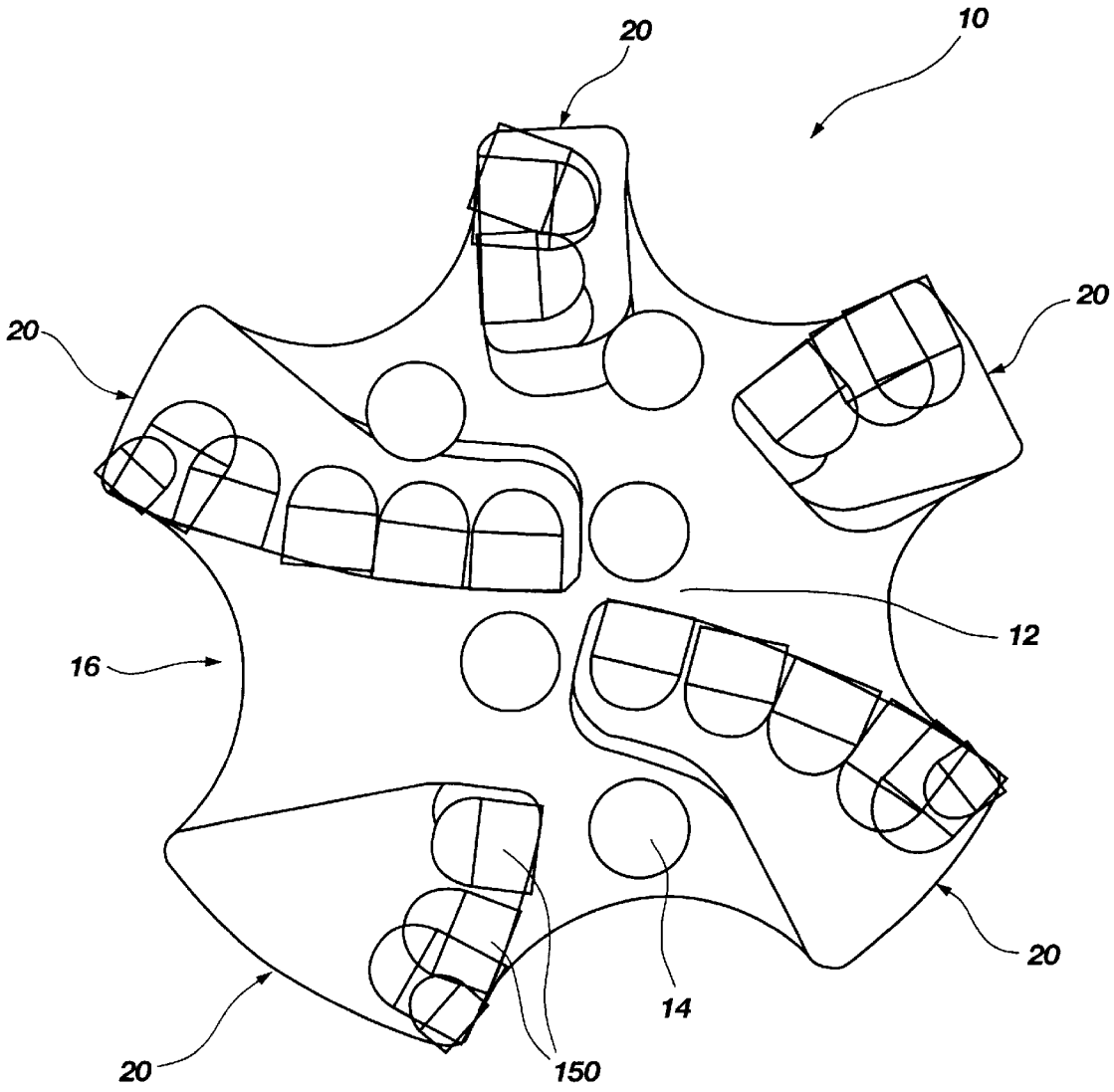
FIG. 2 is a bottom elevation of the drag bit of FIG. 1.

With reference to FIGS. 1 and 2, an exemplary rotary-type earth-boring fixed cutter drill bit 10, which is also referred to simply as a "drag bit", is illustrated. FIG. 1 depicts drag bit 10 as it could be oriented while drilling a formation. FIG. 2 illustrates a face 12 of drag bit 10, which leads drag bit 10 in drilling a formation.

As shown in FIG. 1, drag bit 10 may comprise a bit body formed as a mass of erosion-resistant and abrasion-resistant particulate material 200, such as tungsten carbide (WC), infiltrated with a tough and a ductile binder material 201, such as an iron-nickel alloy, formed over a steel blank 202. Alternatively, drag bit 10 may comprise a steel body. In either event, drag bit 10 includes a shank 204 with a threaded region 206 configured to attach drag bit 10 to a drill string (not shown).

As depicted, drag bit 10 includes five blades 20 that extend generally radially over bit face 12 toward the gage 22 of drag bit 10. Blades 20 may include recesses formed therein, which are referred to as cutter pockets 30, that carry cutting elements, which are also referred to herein as cutters 150 for simplicity. Cutters 150 are oriented so as to cut into a formation upon rotation of drag bit 10. The recessed areas located between gage pads 18 at upper ends of adjacent blades 20 extending radially beyond the bit body are referred to as junk slots 16.

Drag bit 10 also includes internal passages 80, which communicate drilling fluid from the drill string (not shown), through shank 204, to face 12. Passages 80 communicate with face 12 by way of apertures 14 formed in face 12. Apertures 14 are preferably configured to receive nozzles (not shown). The nozzles may be positioned adjacent to face 12 at the ends of passages 80 so as to aim drilling fluid ejected from passages 80 in directions that will facilitate the cooling and cleaning of cutters 150, as well as the removal of formation cuttings and other debris from face 12 of drag bit 10 via junk slots 16.

Figure 3A:
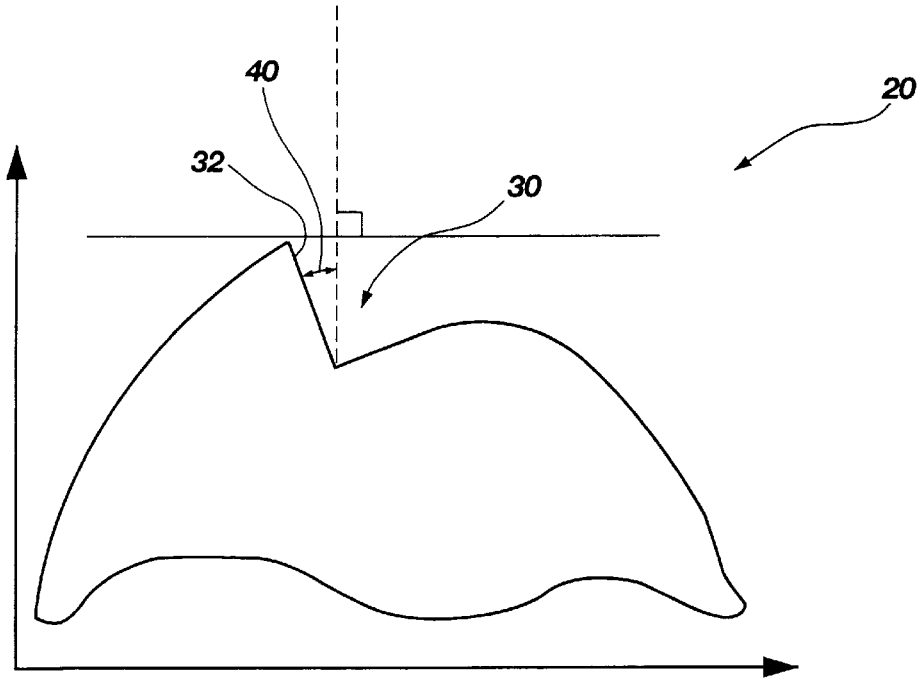
FIG. 3A is a side cross-sectional elevation of a bit blade section containing one cutter pocket.
Figure 3B:
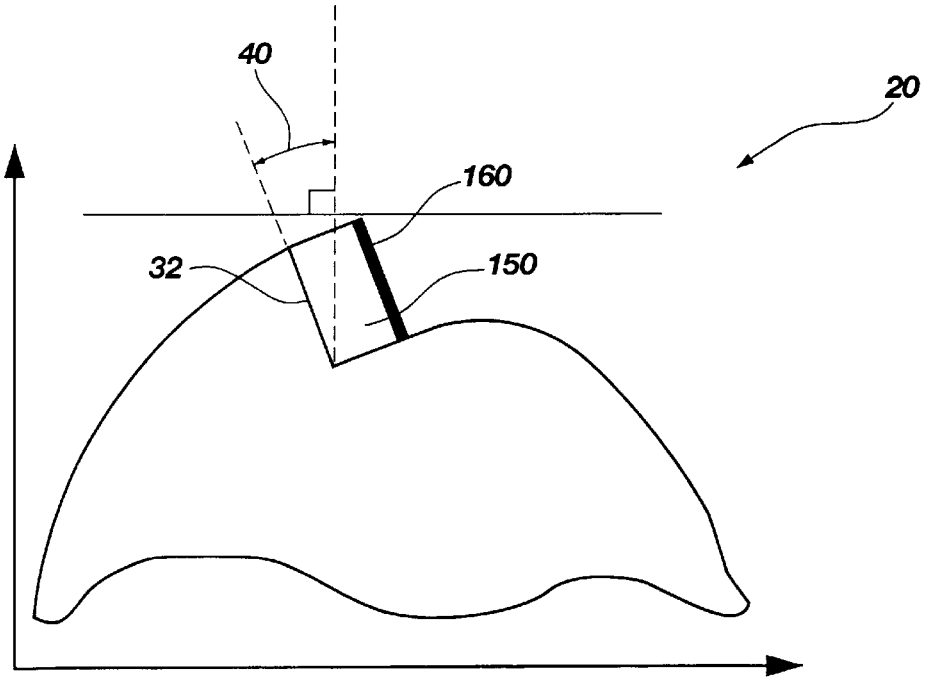
FIG. 3B is a side cross-sectional elevation of the bit blade section illustrated in FIG. 3A, with a cutter disposed in the cutter pocket and illustrating the rake angle of the cutter.

FIG. 3A, which illustrates a section of a blade 20 that includes one cutter pocket 30, the sides of which (see FIG. 2) have been omitted for clarity. Each cutter pocket 30 includes a back surface 32, which is oriented at an angle that imparts a cutting face 160 of a cutter 150 disposed within cutter pocket 30 with a desired rake angle 40 relative to a surface of a formation being drilled, as shown in FIG. 3B. Cutter 150 may be secured within cutter pocket 30 by known processes, such as by brazing or, in some particulate-based drag bits, by positioning cutters 150 carrying TSP compacts within pockets 30 prior to infiltrating the particulate matrix of the bit body. As illustrated in FIG. 3B, cutting face 160 is oriented with a negative rake angle 40, or backrake. In the present invention, however, cutters 150 may also be oriented on drag bits 10 with neutral rake angles or with positive rake angles relative to a surface of the formation being drilled.

The specific manner in which rake angles 40 may be continuously varied in different design embodiments may depend on many factors, including, without limitation, the design of drag bit 10 (e.g., the shape of the profile of drag bit 10), the degree of cutter 150 redundancy, the thickness of the compact, or diamond table, on each cutter 150, the formation to be drilled, the formation pressure (i.e., bore hole stress), and the depth to which a bore hole is to be drilled in the formation. Desired weight on bit or torque responses, as well as directional drilling considerations, may influence embodiments of continuously varying rake angles 40 of cutters 150. Stability data may also be a basis for designing a drag bit 10 with cutters 150 oriented with their cutting faces 160 at continuously varying rake angles 40.

In one exemplary embodiment of the present invention, which is illustrated by FIGS. 4A–4M, a drag bit 10 may carry cutters 150 that are oriented so as to have rake angles that are at least partially dependent upon the radial distances of these cutters 150 from a longitudinal axis 44 of drag bit 10.

FIGS. 4A–4E respectively illustrate each of the different blades 20 (20*a*, 20*b*, 20*c*, etc.,) of drag bit 10 (FIGS. 1 and 2) and the cutters 150 (150A–150V) carried thereby. As shown in FIGS. 4A–4E, cutters 150 are labeled A–V in sequence, depending upon their respective radial distances from longitudinal axis 44, cutter 150A being located closest to longitudinal axis 44 and cutter 150V being most distant from longitudinal axis 44.

FIGS. 4F–4M are graphs that depict different exemplary relationships between the rake angles of cutters 150 and their relative radial distances from longitudinal axis 44. As indicated in each of FIGS. 4F–4M, drag bits according to each of these embodiments include at least one region 70 with cutters 150 having cutting faces 160 that are oriented at rake angles 40 (FIG. 3B) that continuously vary within that region 70. Where appropriate, regions 72 of the graphs are labeled in which a drag bit 10 includes at least two cutters 150 positioned sequential distances (e.g., cutters 150C and 150D) from longitudinal axis 44 that have cutting faces 160 with rake angles 40 that are unequal and vary by less than about five degrees.

Figure 4A:
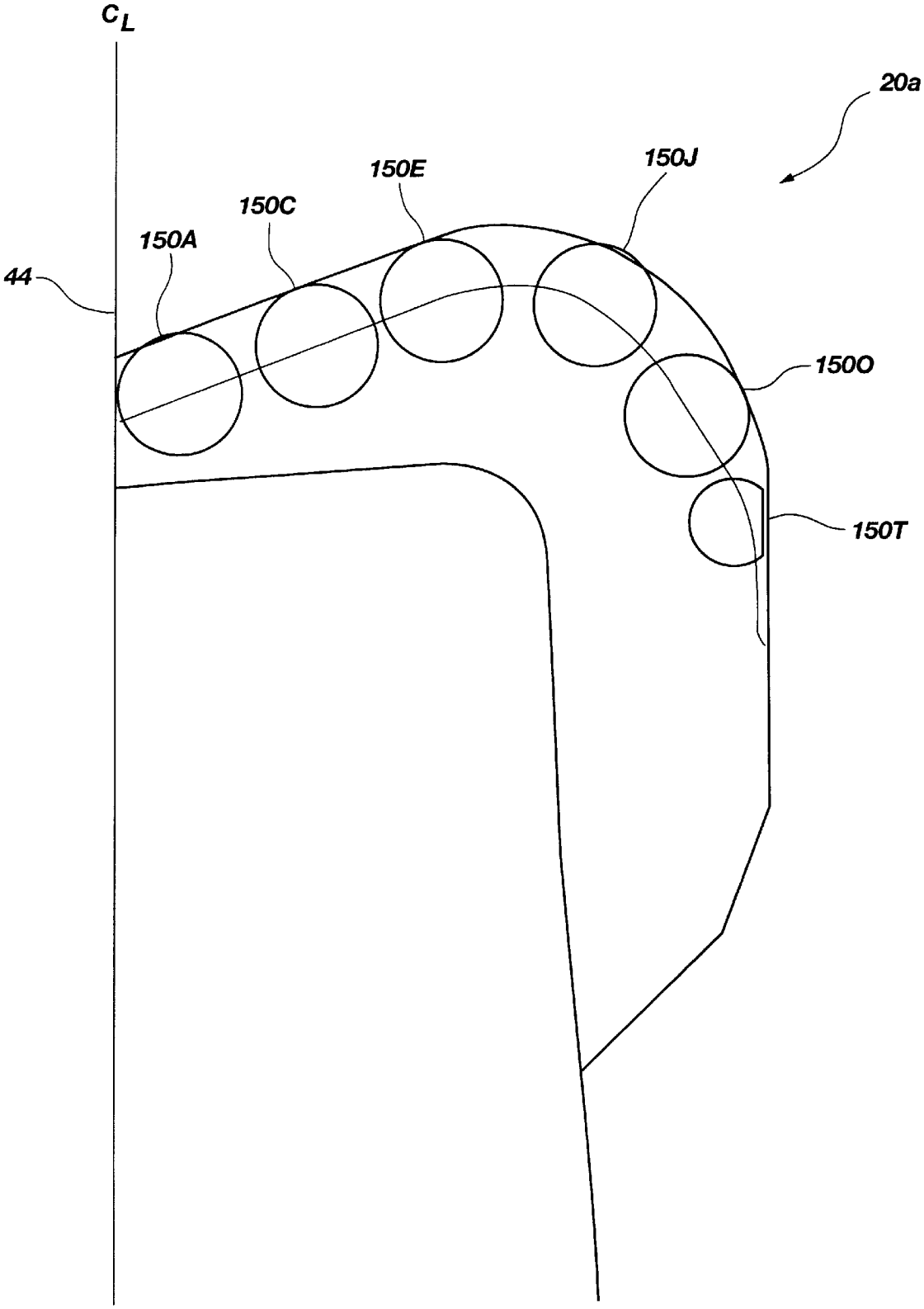
FIGS. 4A–4E are side elevations of each of the five blades of the drag bit of FIG. 1, depicting radial cutter placement in accordance with the present invention.
Figure 4B:
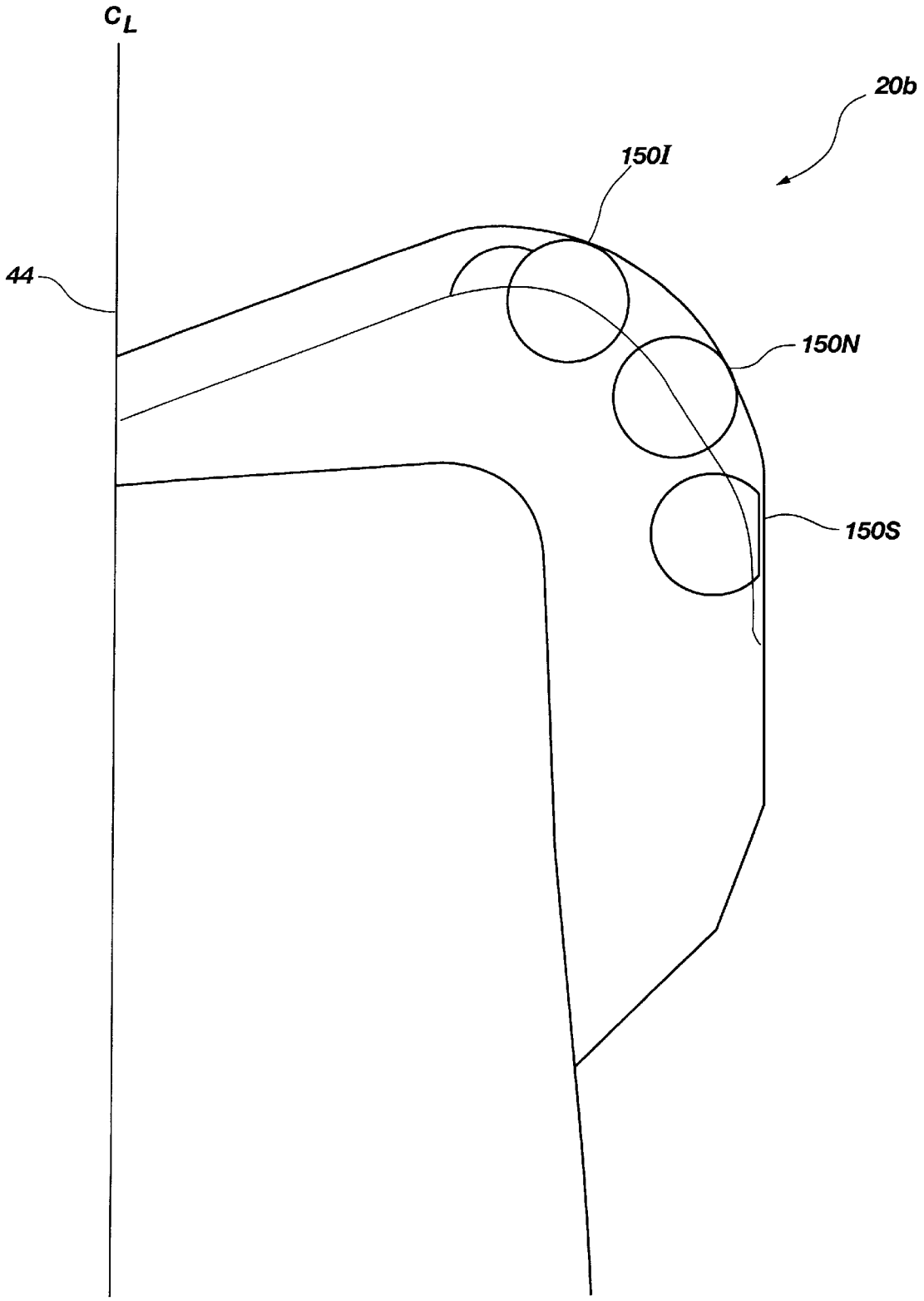
Figure 4C:
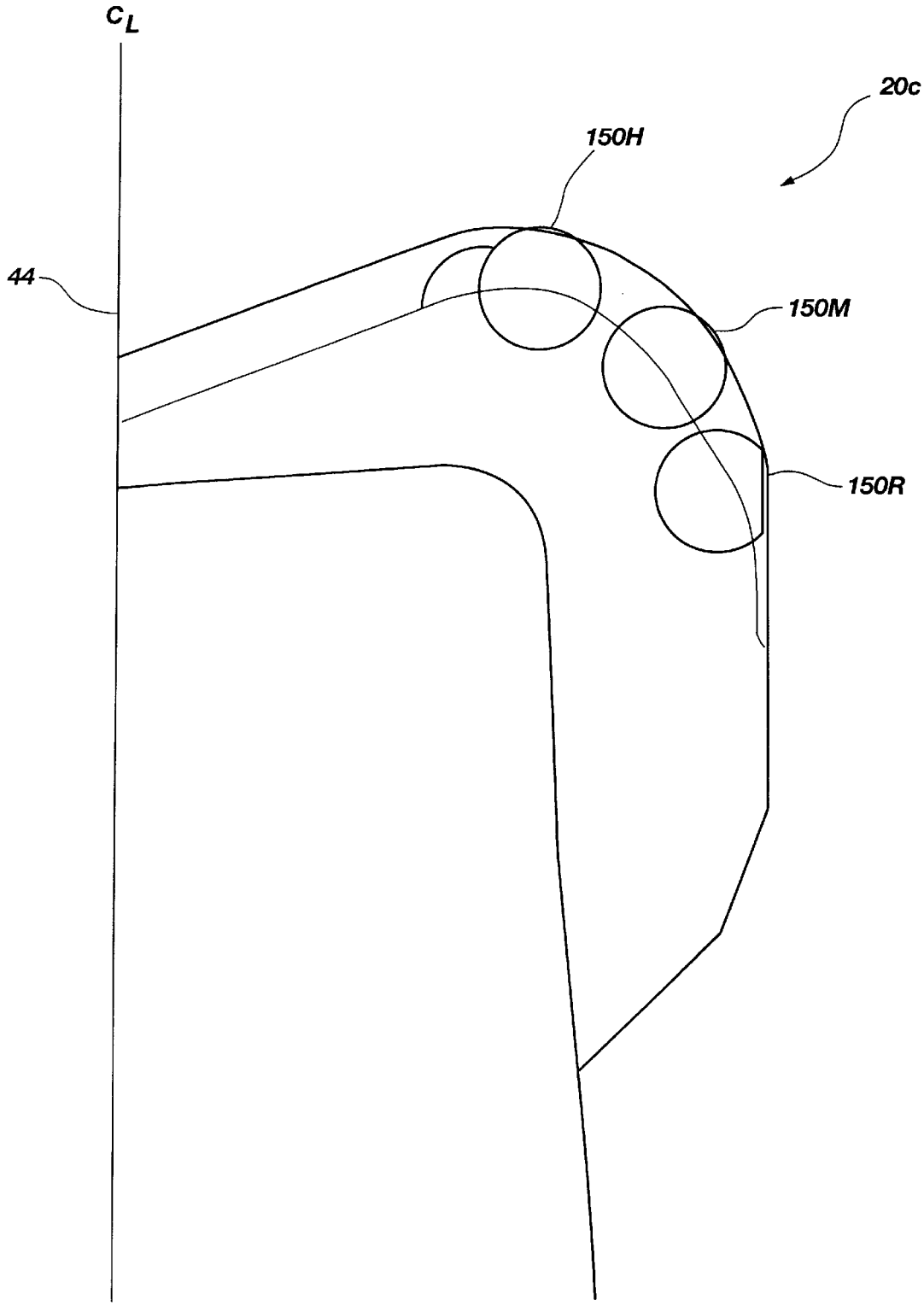
Figure 4D:
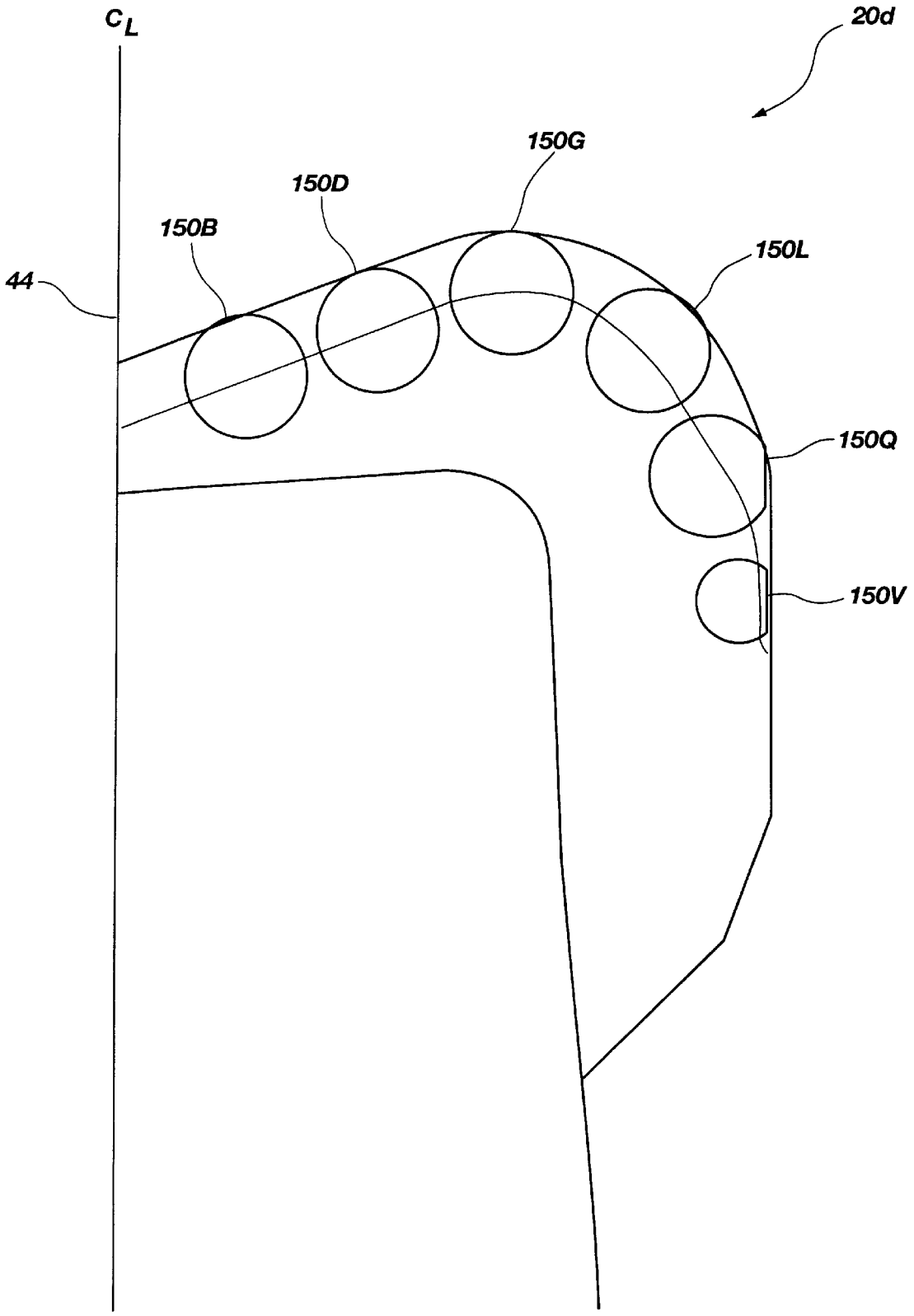
Figure 4E:
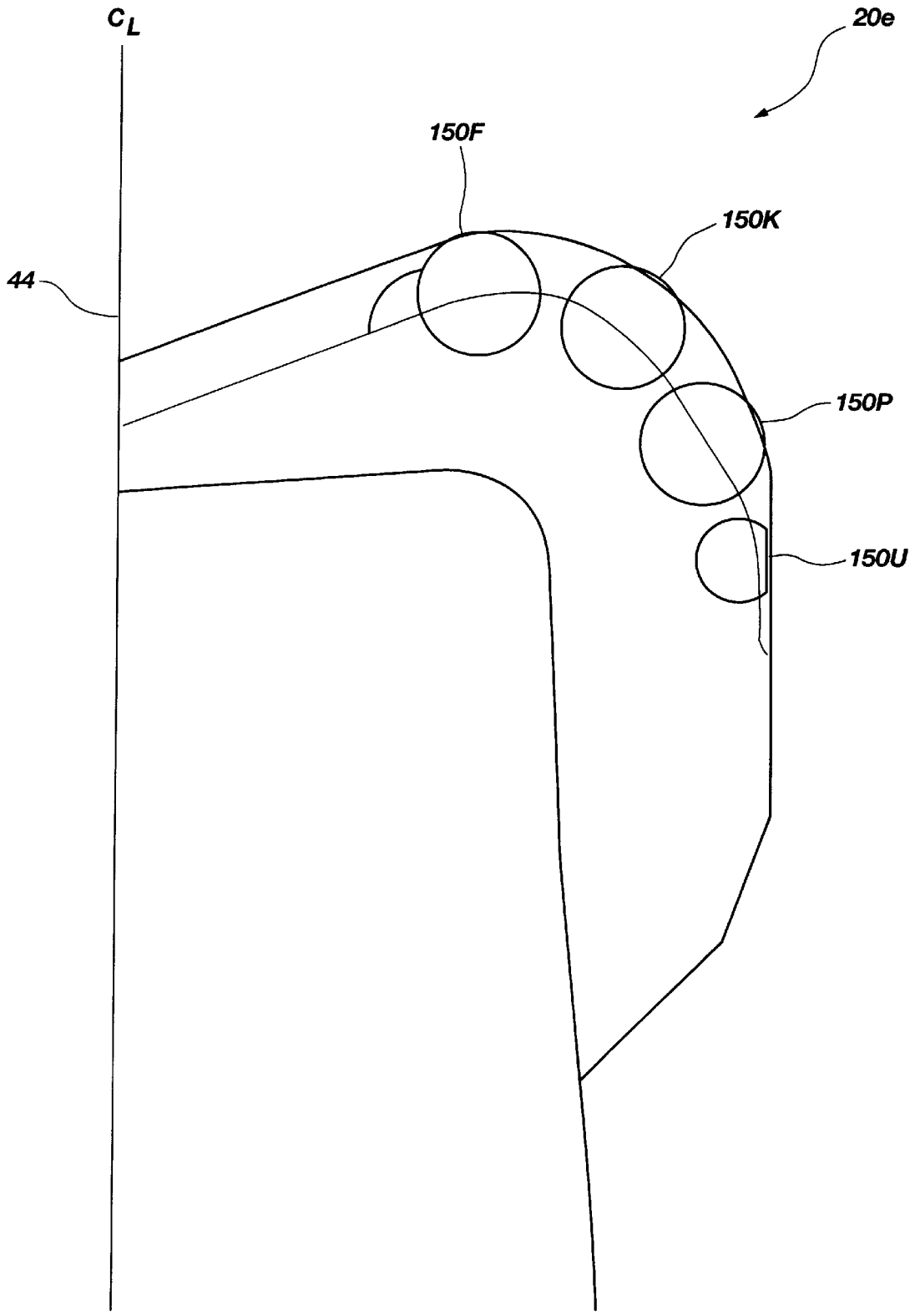
Figure 4F:
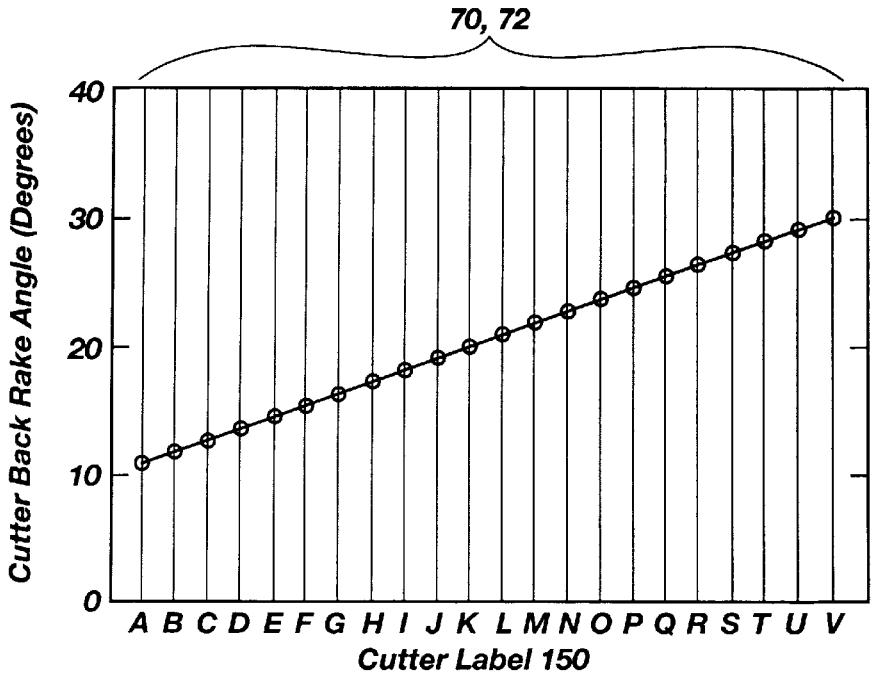
FIGS. 4F–4T graphically depict embodiments for the radial position relationships of the cutters shown in FIGS. 4A–4E and the rake angles of each of these cutters.

As shown in FIG. 4F, the relationship between the radial distances of cutters 150 from longitudinal axis 44 and the rake angles 40 (FIG. 3B) of cutter 150 may be substantially linear. While FIG. 4F depicts cutters 150 being oriented with cutting faces 160 at more negative rake angles 40 the more radially distant cutters 150 are spaced from longitudinal axis, the rake angles 40 of cutting faces 160 of cutters 150 may alternatively become less negative (i.e, more positive) the greater the radial distance between cutters 150 and longitudinal axis 44, as shown in FIG. 4F.

Figure 4G:
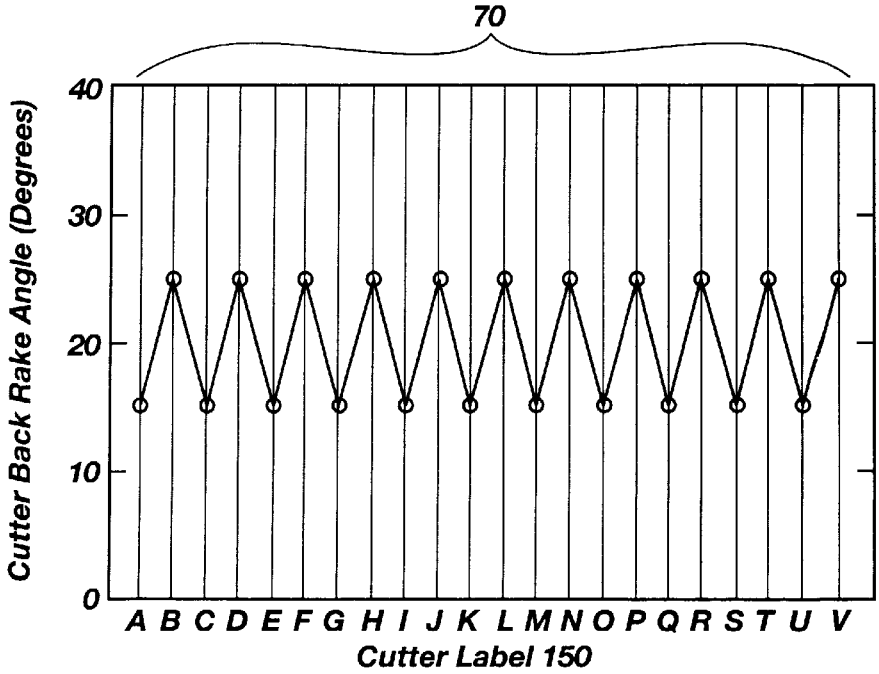

As an alternative, cutting faces 160 of cutters 150 may be positioned at rake angles that vary, in a somewhat cyclical relationship, as depicted in FIG. 4G. As illustrated in FIG. 4G, the rake angles 40 of cutting faces 160 of cutters 150 are independent of the radial distance of each cutter 150 from longitudinal axis 44. Rather, the rake angle 44 of each cutter 150 (e.g., cutter 150C) may be related to the rake angle 40 of the previous, more closely spaced cutter 150 (e.g., cutter 150B) or upon the rake angle 40 of the next, more distantly spaced cutter 150 (e.g., cutter 150D). By way of example, FIG. 4G depicts cutters 150B and 150D as having cutting faces 160 that are oriented with a negative rake of about 25°, while cutting face 160 of cutter 150C, which is spaced a radial distance from longitudinal axis 44 that lies between the distances that cutters 150B and 150D are spaced radially from longitudinal axis 44, is oriented with a negative rake of about 15°.

Figure 4H:
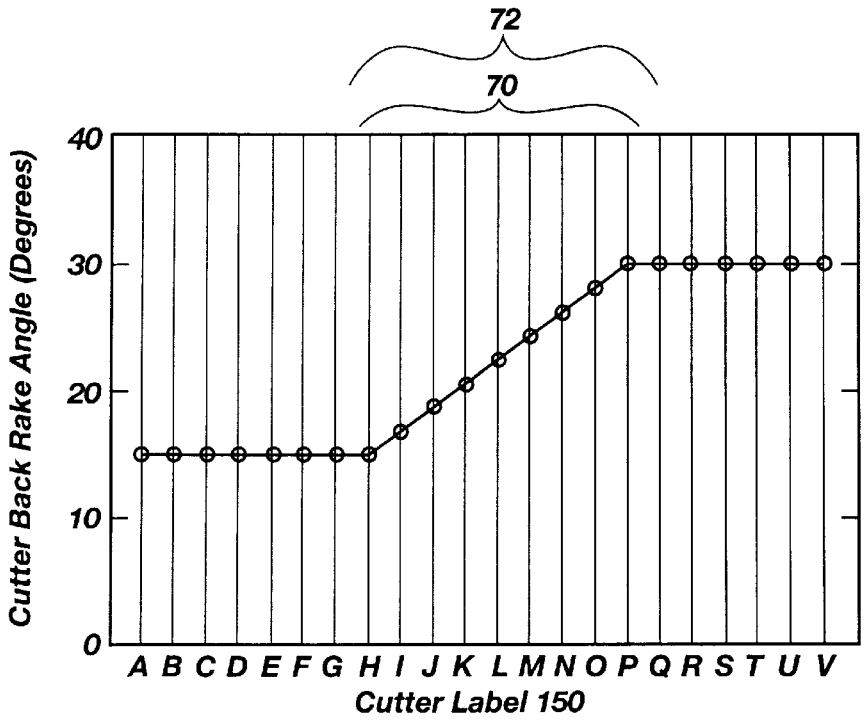

FIG. 4H graphically depicts the orientation of cutters 150 on a drag bit 10 that includes three regions. Cutting faces 160 of cutters 150A–150G, which are located in a first region of drag bit 10 and are located closest to longitudinal axis 44 thereof, are oriented so as to have substantially the same rake angles 40. A second, intermediate region 70/72 of drag bit 10 includes cutters with cutting faces 160 oriented at a variety of different rake angles 40. As shown, the rake angles 40 of cutting faces 160 of cutters 150H–150P become less negative the further cutters 150IH–150P in second intermediate region 70/72 are radially spaced from longitudinal axis 44. Cutters 150 within region 70/72 are arranged with their cutting faces 160 oriented at different rake angles 40, the rake angle 40 of cutting face 160 of each sequential cutter 150H, 150I, 150J, etc. varying by less than about five degrees from the rake angles 40 of the cutting faces 160 of the previous and subsequent cutters 150. A third region of drag bit 10, which is most distantly radially spaced from longitudinal axis 44, includes cutters 150Q–150V having cutting faces 160 that are oriented at substantially the same rake angles 40 relative to a surface of a formation to be drilled. The rake angles 40 of the cutting faces 160 of cutters 50A–150G, located in the first region of face 12 of drag bit 10, are less negative than the rake angles 40 of the cutting faces 160 of cutting elements 150Q–150V, which are located in the third region of face 12.

Figure 4I:
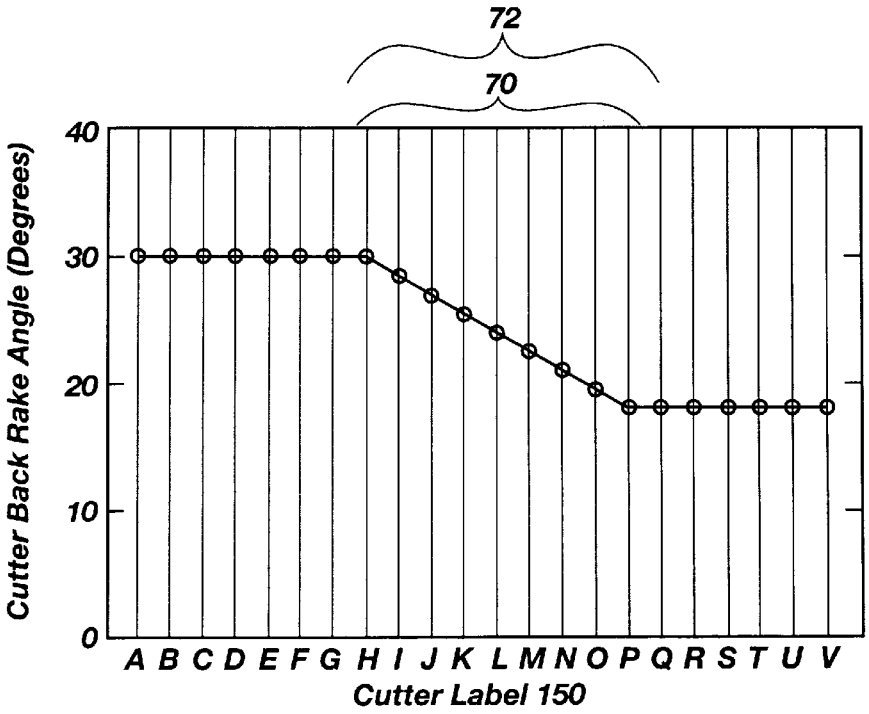

FIG. 4I graphically represents another drag bit 10 with cutters 150 located in three regions of face 12. Conversely to the arrangement of cutters 150 illustrated in FIG. 4H, the cutting faces 160 of cutters 150A–150G in a first region of face 12 are oriented with more negative rake angles 40 than are cutting faces 160 of cutters 150Q–150V located in the third region of face 12. To provide a transition between the rake angles 40 of the cutting faces 160 of cutters 150 of the first and third regions, the rake angles 40 of cutting faces 160 of cutters 150H–150P within the second, intermediate region 70/72 of face 12 become less negative the more distantly each cutter 150 is positioned from longitudinal axis 44 of drag bit 10. As in the graphical illustration of FIG. 4H, FIG. 4I illustrates that rake angles 40 of cutting faces 160 of cutters 150 within region 70/72 are arranged with their cutting faces 160 oriented at different rake angles 40 and that the rake angle 40 of cutting face 160 of each sequential cutter 150H, 150I, 150J, etc. varies by less than about five degrees from the rake angles 40 of the cutting faces 160 of the previous and subsequent cutters 150.

Figure 4J:
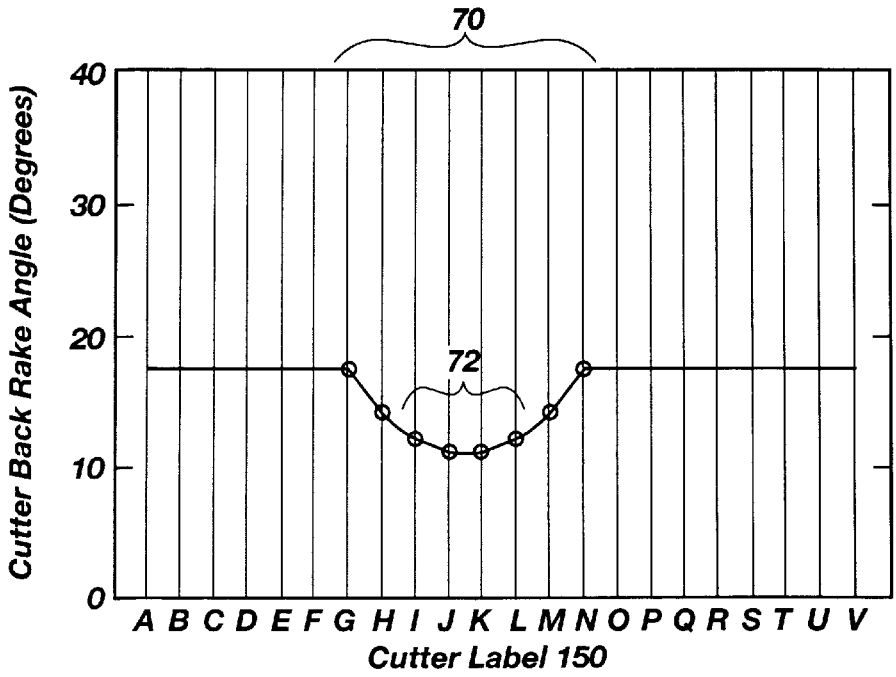
Figure 4K:
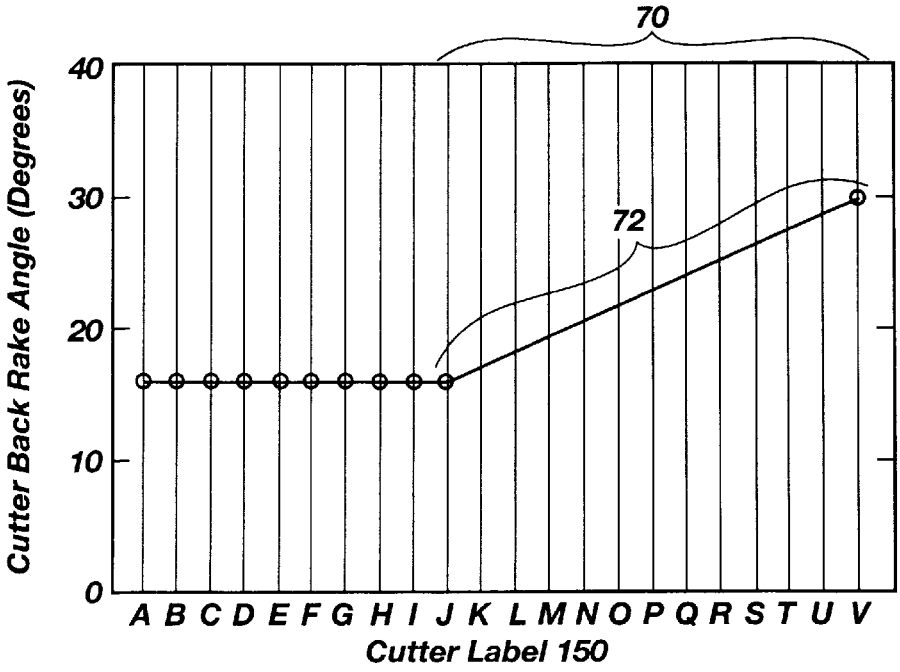
Figure 4L:
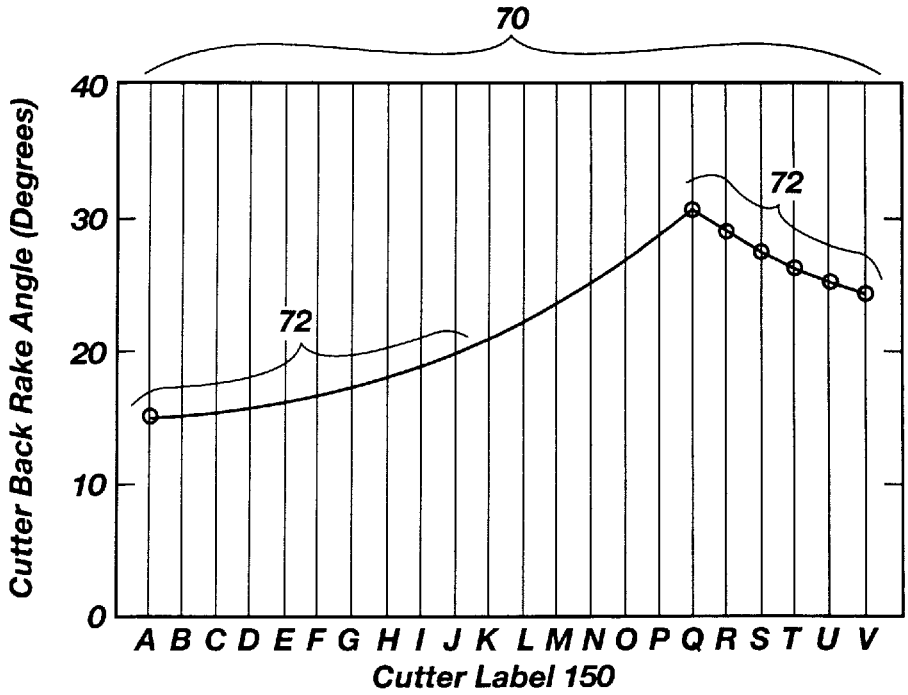
Figure 4M:
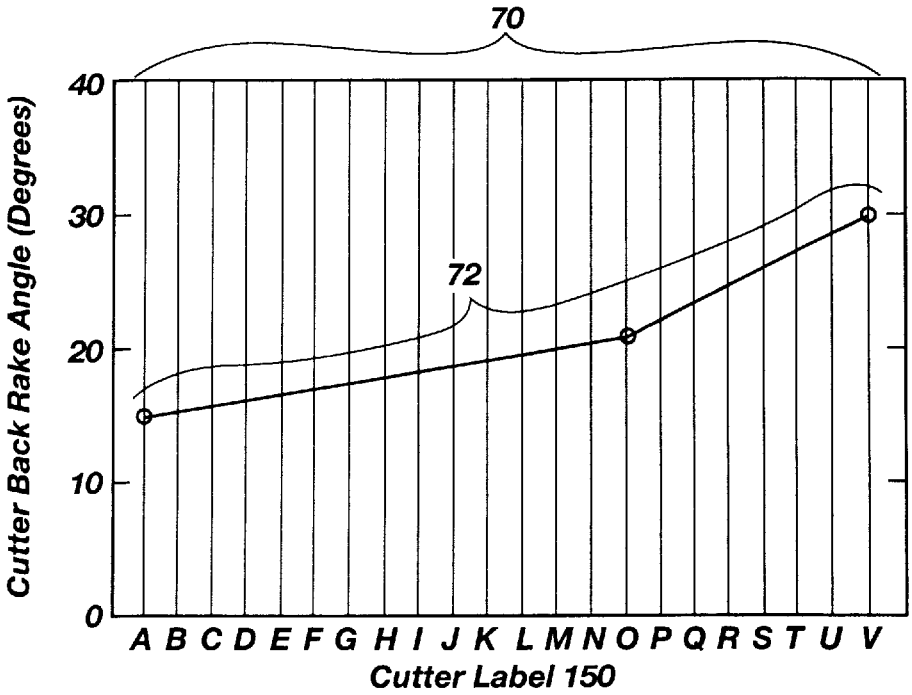
Figure 4N:
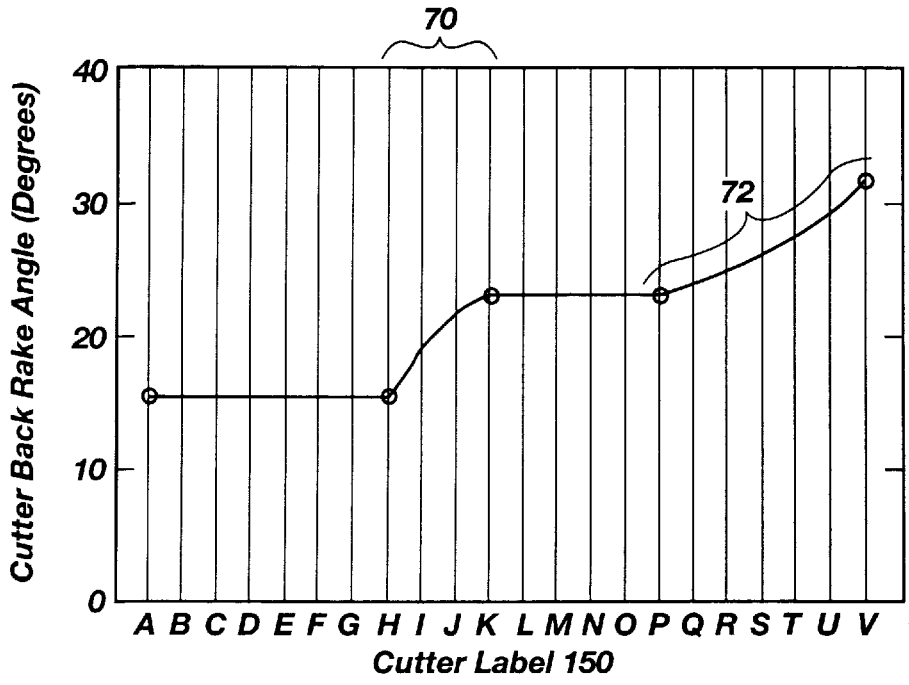
Figure 4O:
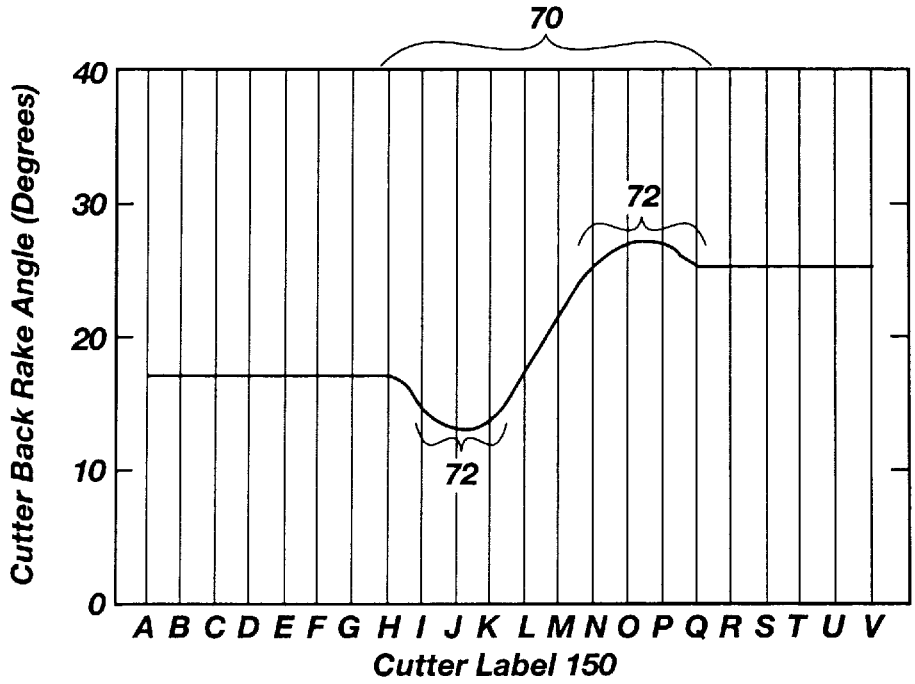
Figure 4P:
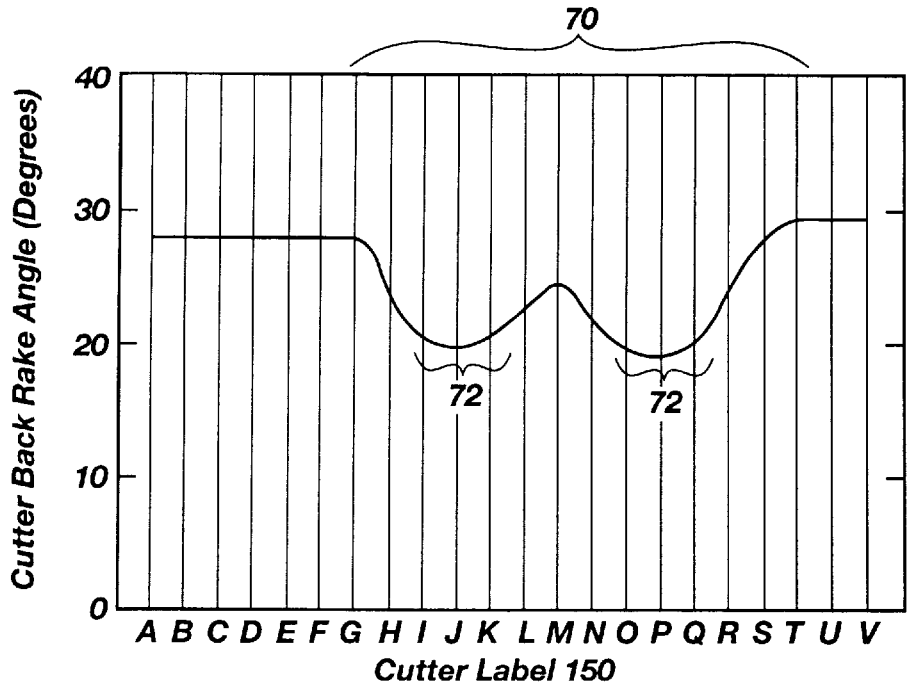
Figure 4Q:
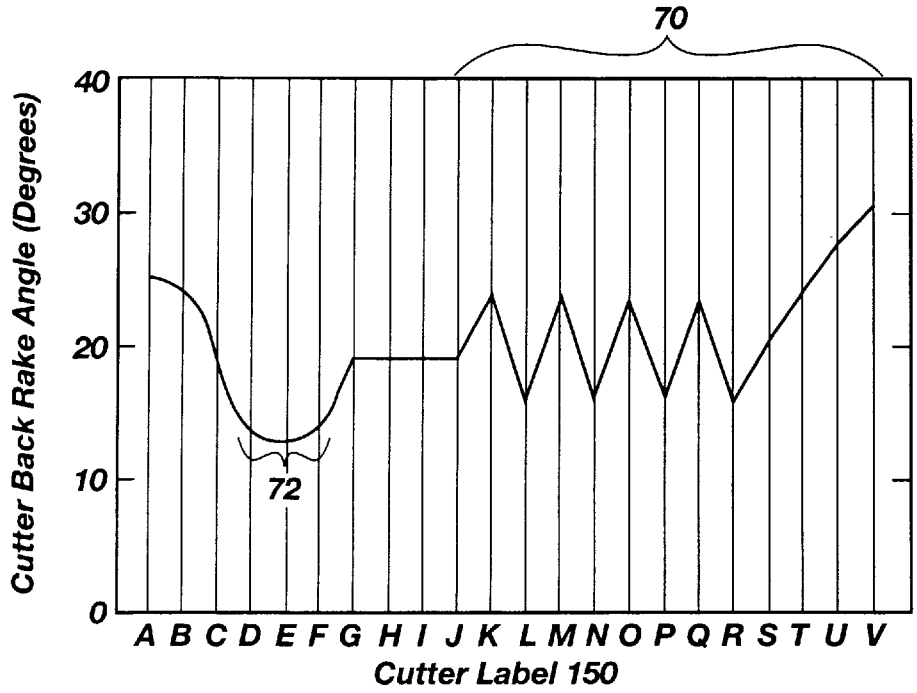
Figure 4R:
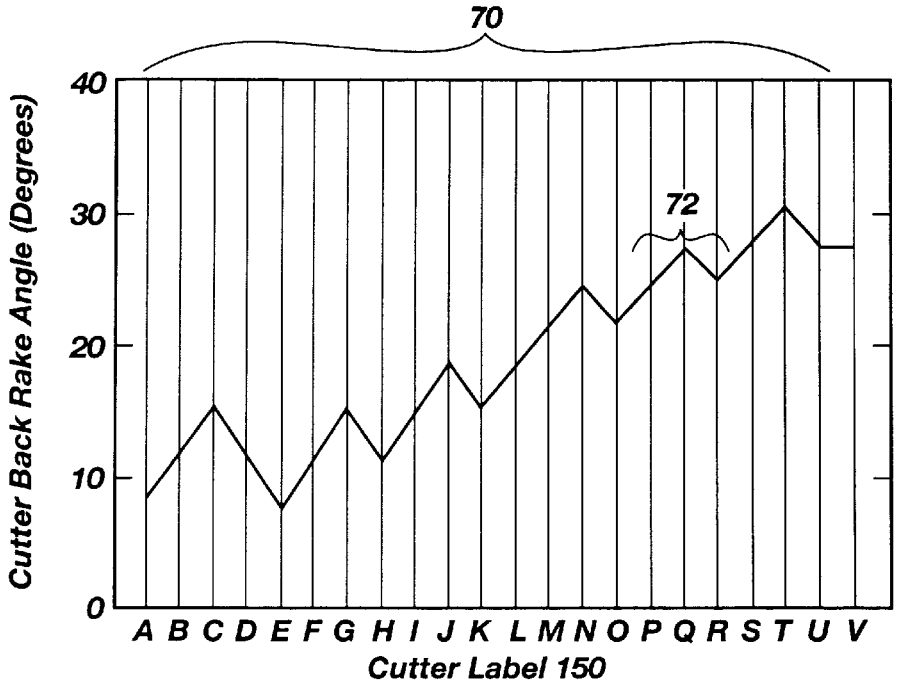
Figure 4S:
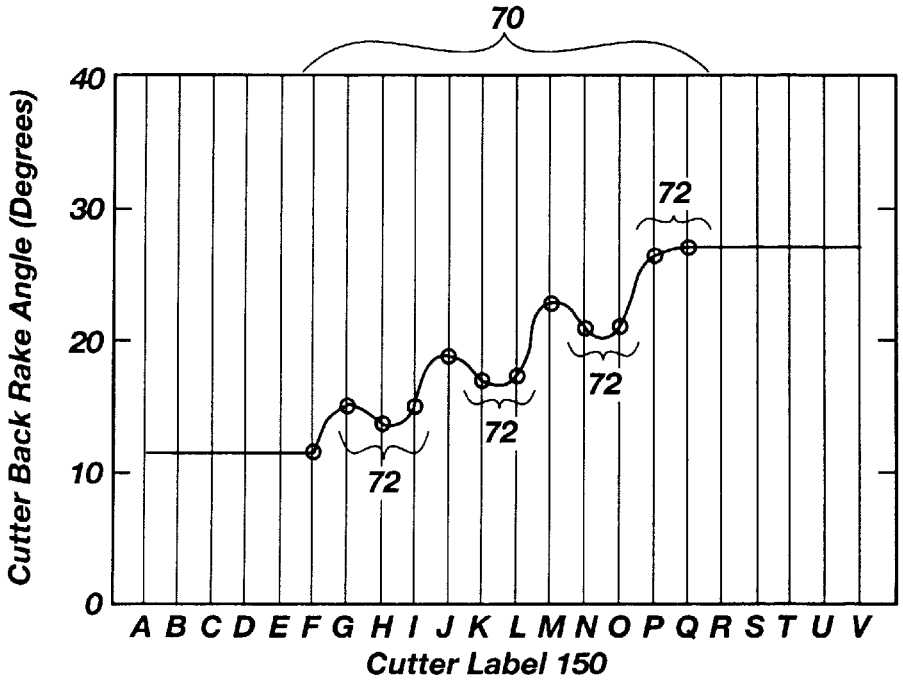

FIG. 4J also graphically represents the rake angles 40 of the cutting faces 160 of cutters 150 arranged in three regions of a face 12 of a drag bit. Cutters 150A–150F, which are located closest to a longitudinal axis 44 of drag bit 10, are carried upon a first region of face 12. Cutters 150G–150N are spaced a greater radial distance from longitudinal axis 44 than are cutters 150A–150F and are located on an intermediate, second region of face 12. The third region of face 12 carries cutters 150O–150V, which are spaced even greater radial distances from longitudinal axis 44. While FIG. 4J depicts cutters 150A–150F and cutters 150O–150V as having cutting faces 160 that are oriented at substantially the same rake angles 40, cutters 150 within the second region of face 12 that are spaced sequential radial distances from longitudinal axis 44 (e.g., cutters 150G and 150H) have cutting faces 160 that are oriented at different rake angles 40 commencing with a decrease in backrake followed by an increase in a nonlinear progression, with cutting faces 160 of cutters 150 spaced intermediate radial distances from longitudinal axis 44 (e.g., cutter 150K) being oriented at the most negative rake angles 40.

FIGS. 4K–4T graphically depict other arrangements of cutters 150 including regions with continuously variable rake angles 40 that incorporate teachings of the present invention.

FIGS. 5A–5L schematically and graphically depict another embodiment of a design layout for cutters 150' for a drag bit 10', wherein rake angles 40 of the cutting faces 160' of cutters 150' are related, at least in part, to the vertical positions of cutters 150' relative to a longitudinal axis 44' of drag bit 10'.

Figure 5A:
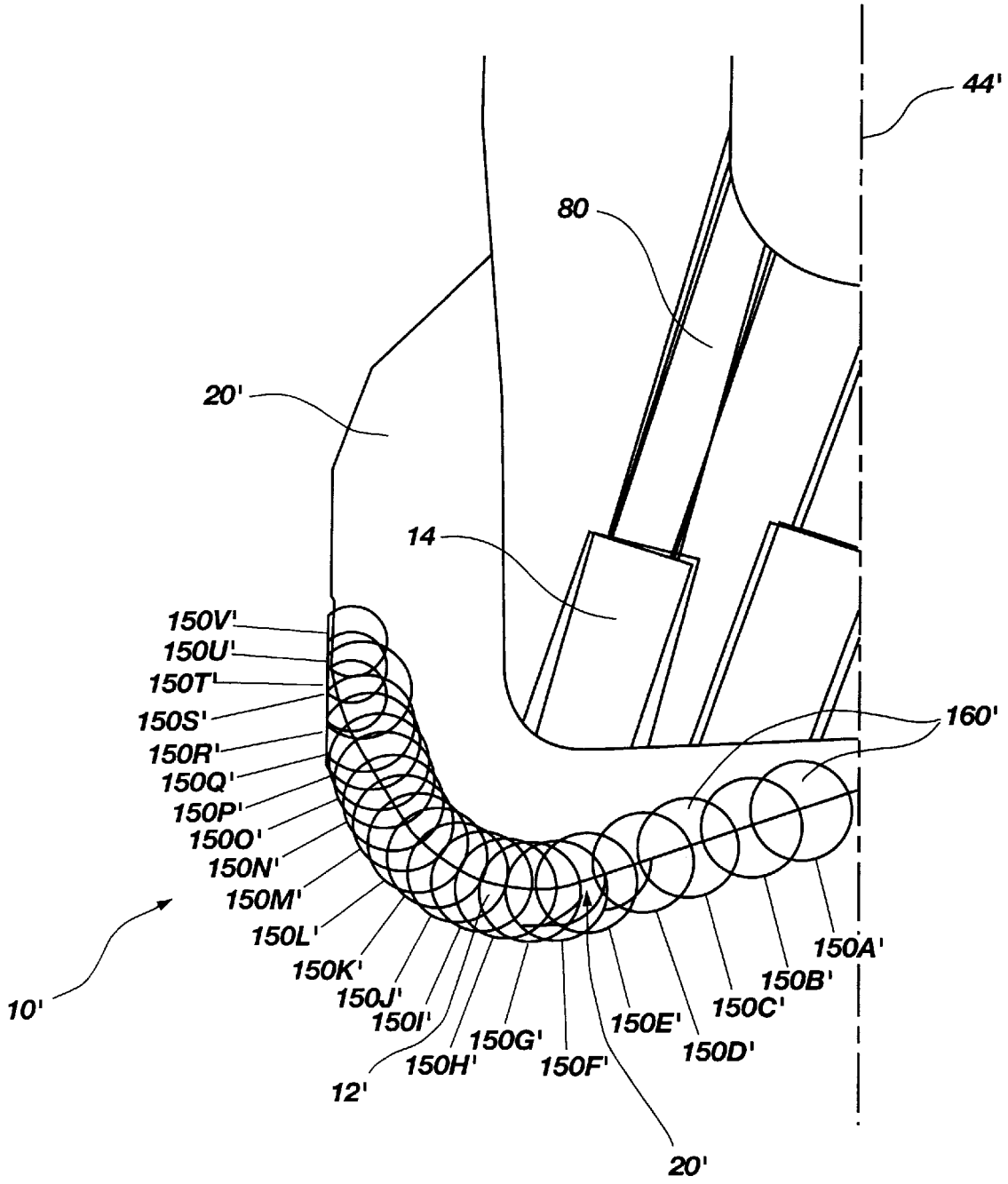
FIG. 5A schematically depicts a cutter design layout for a drill bit and illustrates radial and longitudinal cutter positions.
Figure 4T:
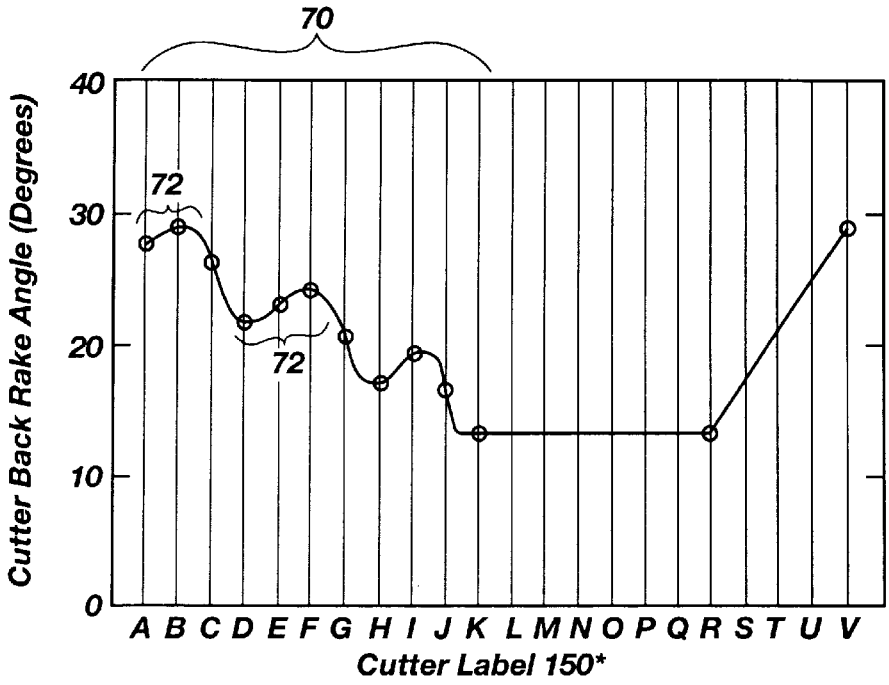
Figure 5B:
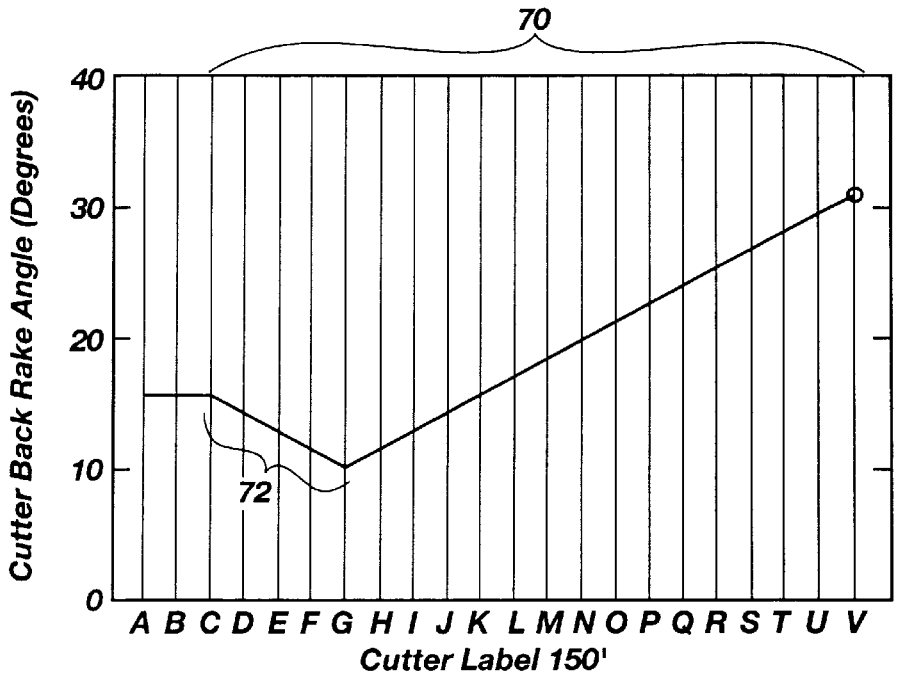
FIGS. 5B–5E graphically depict embodiments for vertical position relationships of the cutters shown in FIG. 5A and the rake angles of these cutters.
Figure 5C:
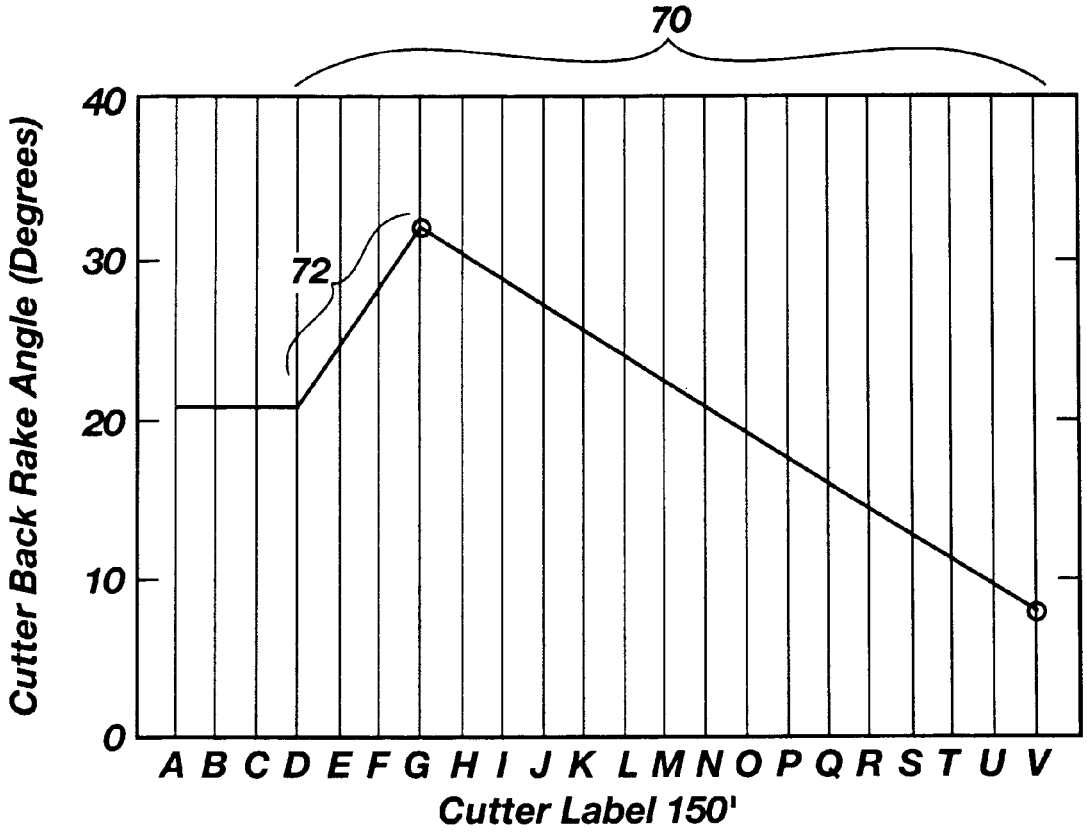
Figure 5D:
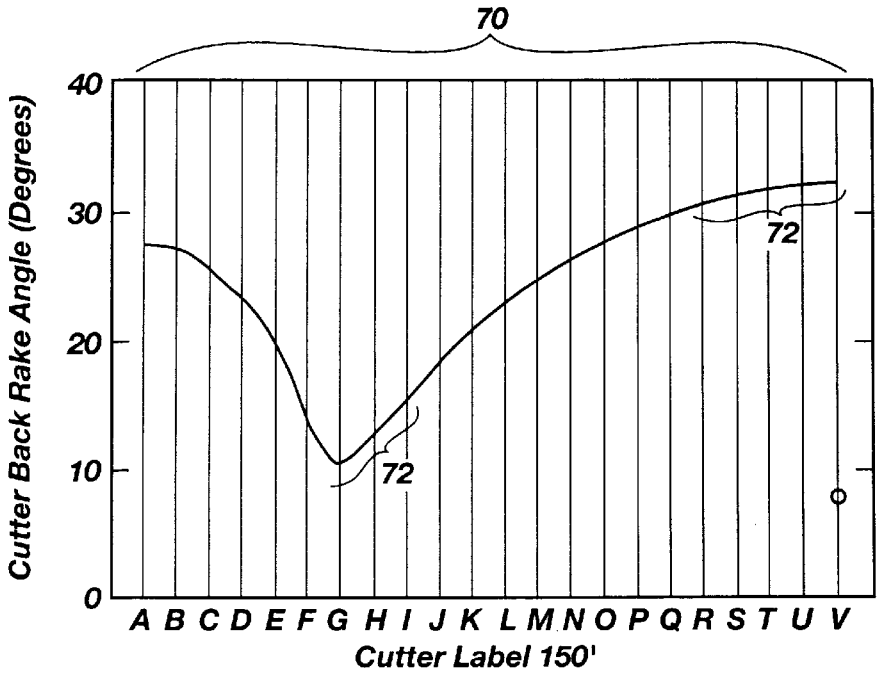
Figure 5E:
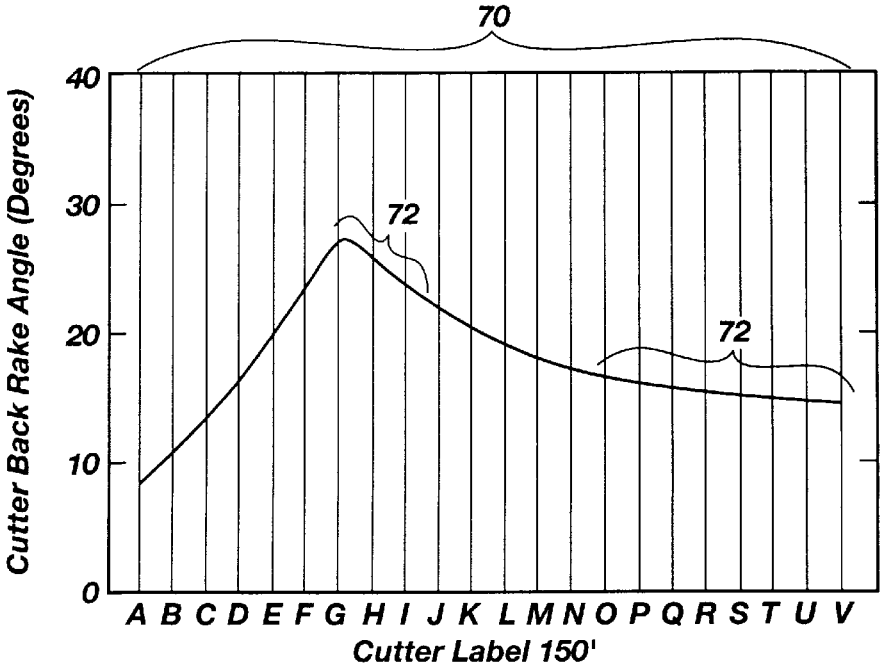

As illustrated in FIG. 5A, drag bit 10' includes a face 12' and blades 20' upon which a plurality of cutters 150A'–150V', which are collectively referred to as cutters 150', are oriented. Although all of cutters 150' are depicted in FIG. 5A as being located on a single blade 20', FIG. 5A merely depicts the positions of cutters 150' relative to one another with respect to both a longitudinal axis 44' of drag bit 10' and a vertical position along longitudinal axis 44'. In actuality, cutters 150' are carried on various blades 20', the cutter positions having been rotated into a single plane for clarity. The sequence of cutters 150A'–150V' is, however, based on the relative radial distances of cutters 150A'–150V' from longitudinal axis 44', with cutter 150A' being located closest to longitudinal axis 44' and cutter 150V' being radial spaced the greatest distance from longitudinal axis 44'.

FIGS. 5B–5E depict various exemplary relationships between the vertical position of each cutter 150' along the longitudinal axis 44' of drag bit 10' and the rake angle 40 of the cutting face 160' of each cutter 150'. As shown in FIGS. 5B–5E, each of the exemplary relationships between the vertical positions of cutters 150' and the rake angles 40 at which cutting faces 160' of cutters 150' are oriented includes regions 70 on face 12' that carry sets of two or more sequentially positioned cutters 150' that are oriented such that the rake angles 40 of their respective cutting faces 160' vary continuously. In at least some regions 72, the rake angles 40 of sequentially positioned cutters 150' vary by less than about five degrees.

As shown in FIG. 5A, of cutters 150A'–150V', cutter 150G' is in the lowermost position along longitudinal axis 44', while cutter 150V' is in the uppermost position along longitudinal axis 44'. The exemplary cutter 150' arrangements depicted in FIGS. 5B–5E illustrate that the rake angle 40 of cutting face 160' of the lowermost cutter 150G' may be the maximum rake angle or the minimum rake angle of all of cutters 150'. Nonetheless, other rake angle orientations of cutters 150' that are related to the relative vertical positions of at least some cutters on a drag bit 10' are also within the scope of the present invention.

Turning now to FIGS. 6A–6G, an embodiment of a cutter 150" rake angle 40 arrangement is illustrated that takes into account the relative positions of cutters 150" along a single blade 20" of a drag bit 10".

Figure 6A:
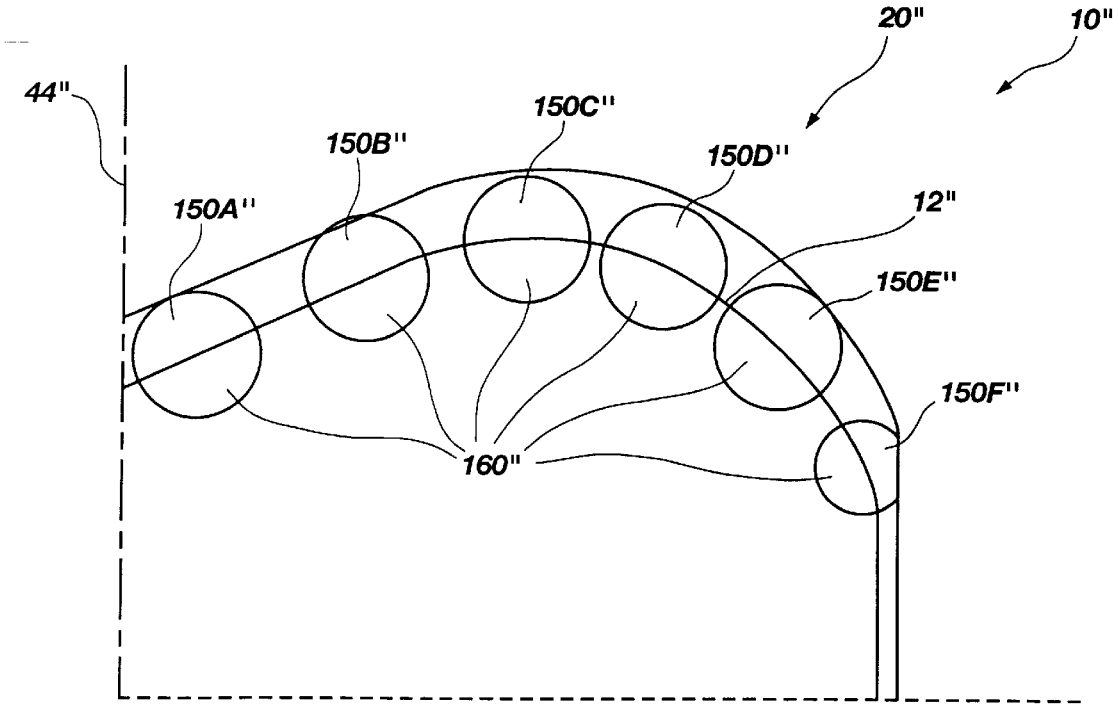
FIG. 6A is a side elevation of a bit blade depicting the radial positions of cutters along the blade.

As shown in FIG. 6A, drag bit 10" includes a blade 20" that carries cutters 150A"–150F", which are collectively referred to herein as cutters 150". FIGS. 6B–6G illustrate different possible relationships between the positions of cutters 150" along blade 20", or the radial distances of cutters 150" on a single blade 20" from a longitudinal axis 44" of drag bit 10", and the rake angles 40 at which cutting faces 160" of cutters 150" are oriented. Again, the rake angles 40 of at least some cutters 150" sequentially positioned within a region 70 of blade 20" are continuously varied. Blade 20" may also include adjacently positioned cutters 150", which are identified in FIGS. 6B–6G by reference numeral 72, that have cutting faces 160" oriented at rake angles 40 that differ by less than about five degrees from one another.

In FIGS. 7A–7F, yet another embodiment of a continuously varied cutting face 160'" rake angle 40 arrangement incorporating teachings of the present invention is illustrated.

Figure 7A:
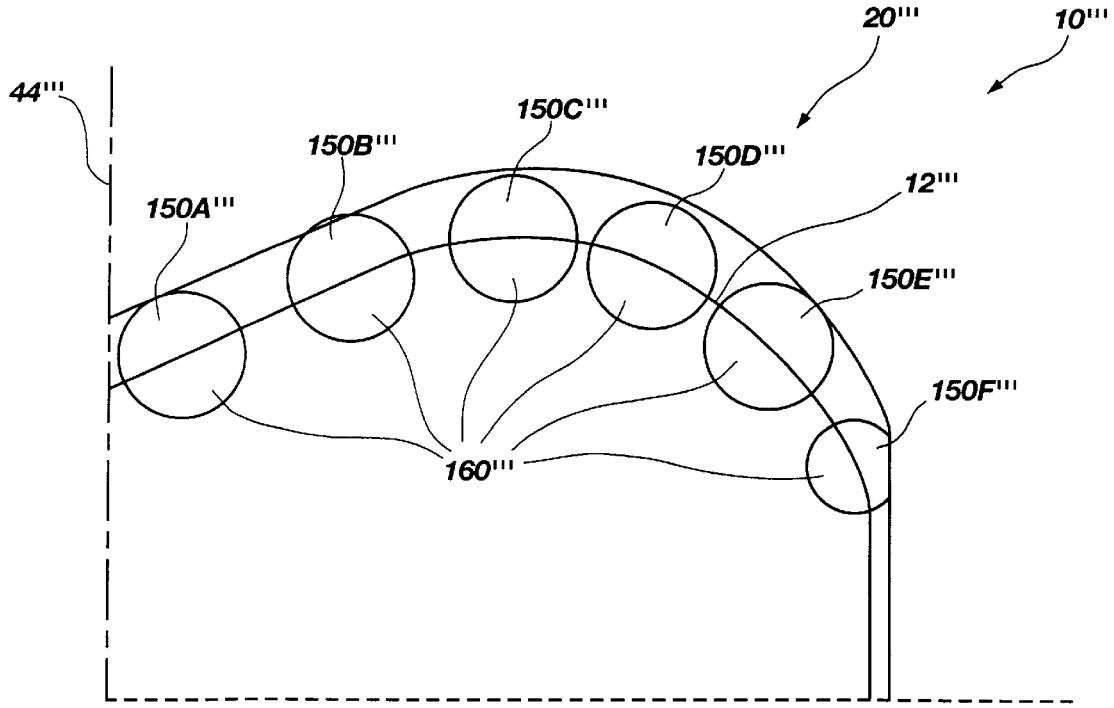
FIG. 7A is a side elevation of a bit blade depicting the vertical positions of the cutters carried thereby.
Figure 6B:
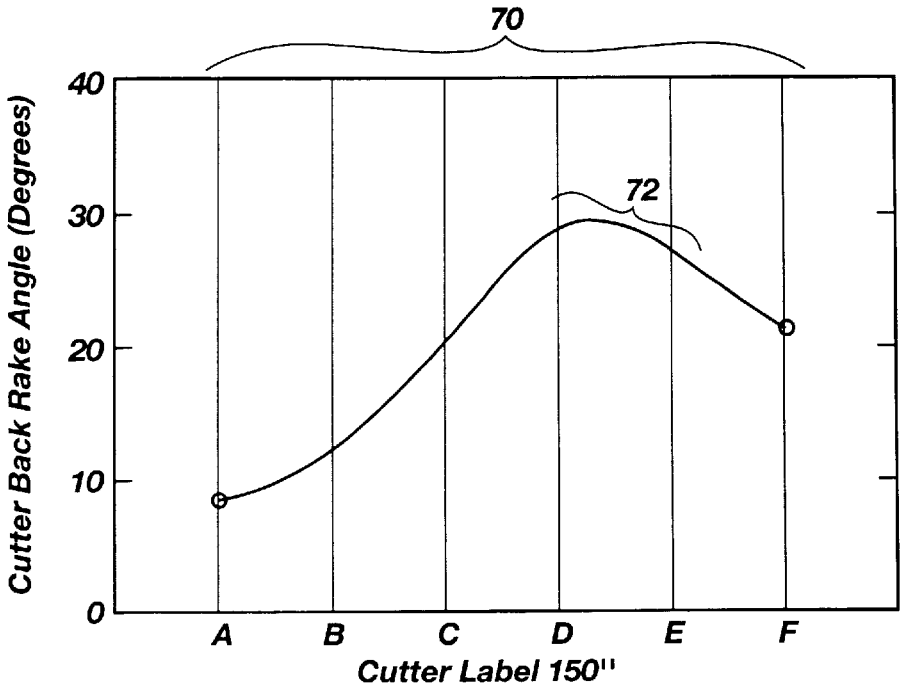
FIGS. 6B–6G graphically depict the relationships between the radial positions of the cutters shown in FIG. 6A along a single blade and the rake angles of each of these cutters.
Figure 6C:
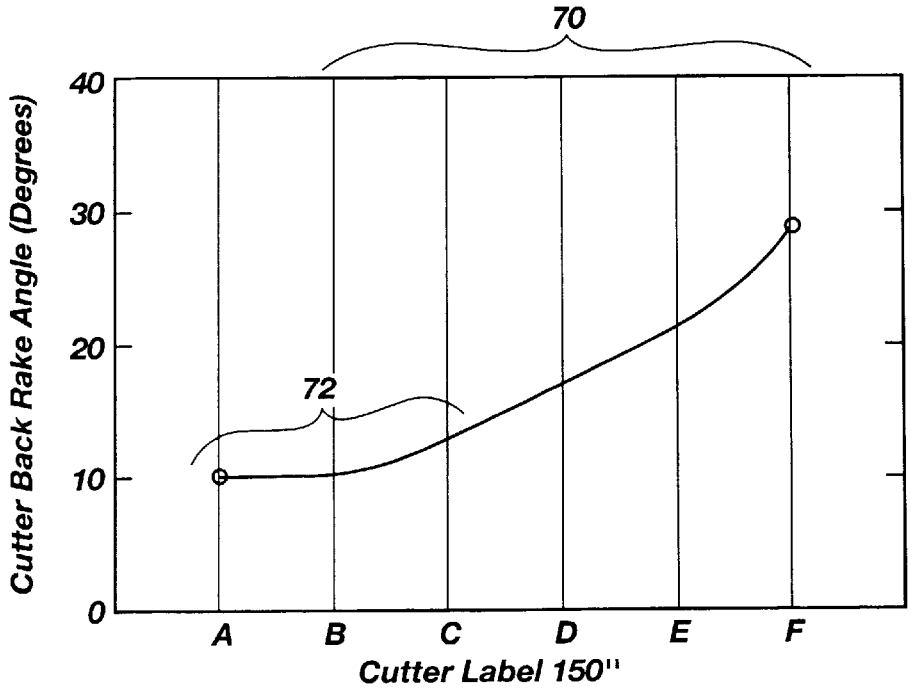
Figure 6D:
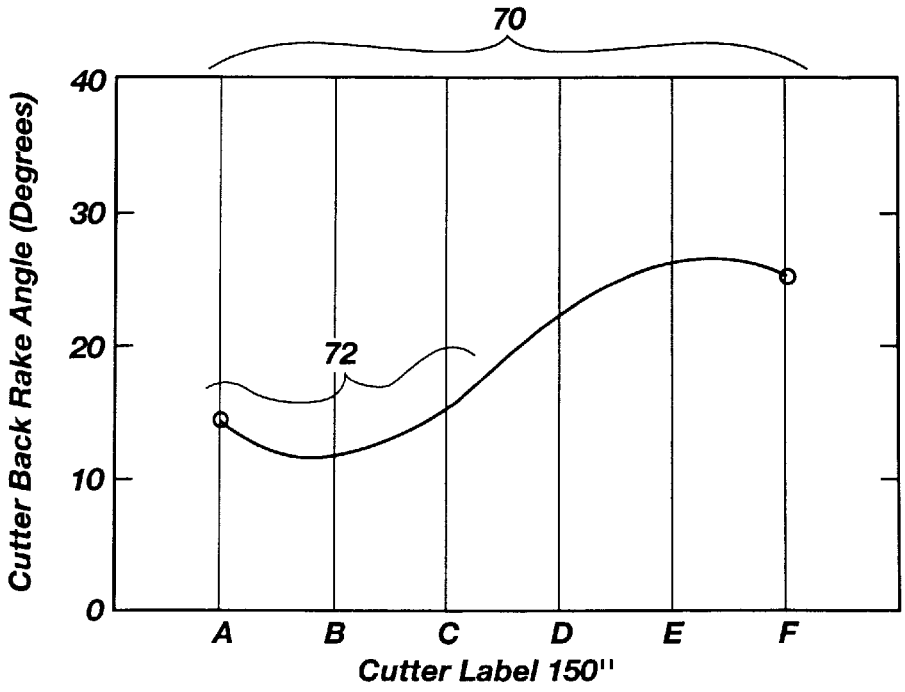
Figure 6E:
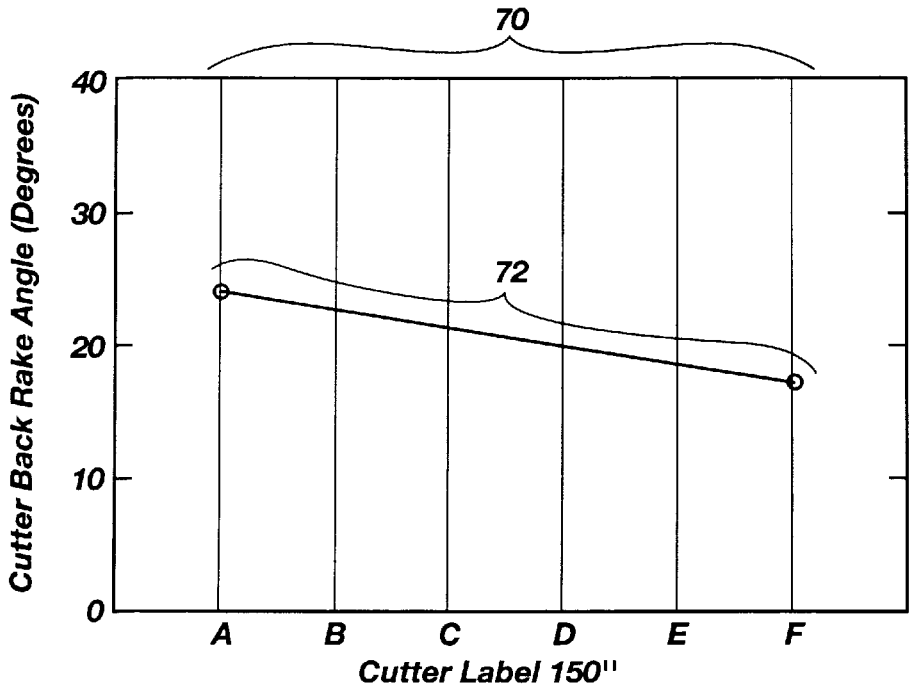
Figure 6F:
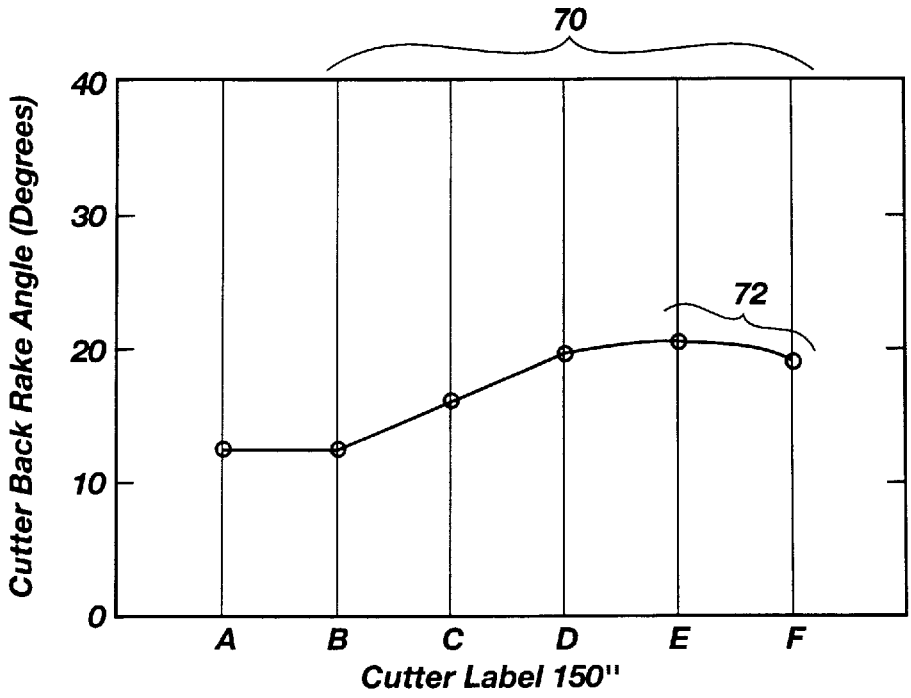
Figure 6G:
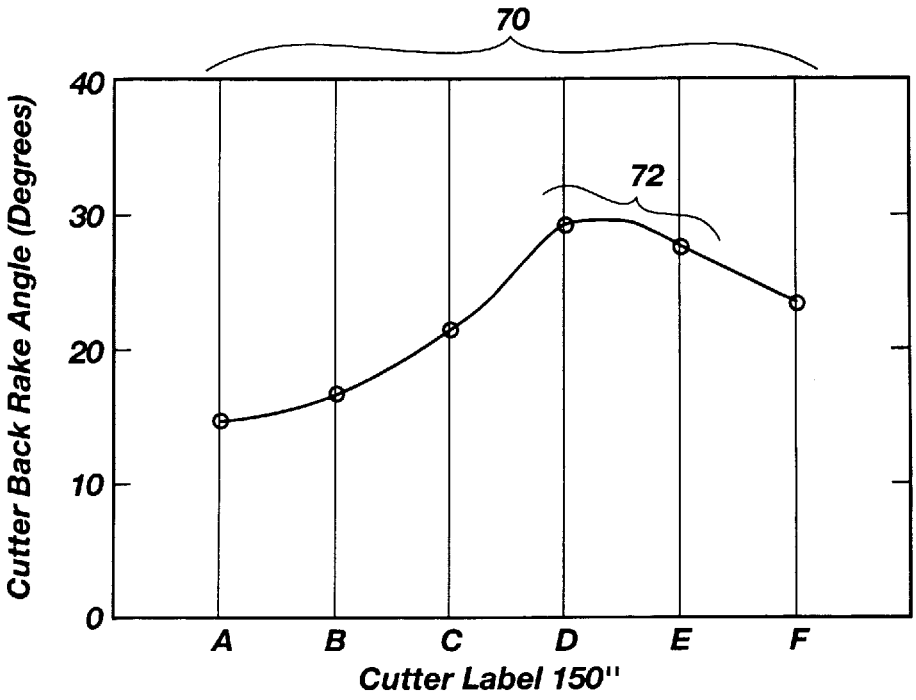
Figure 7B:
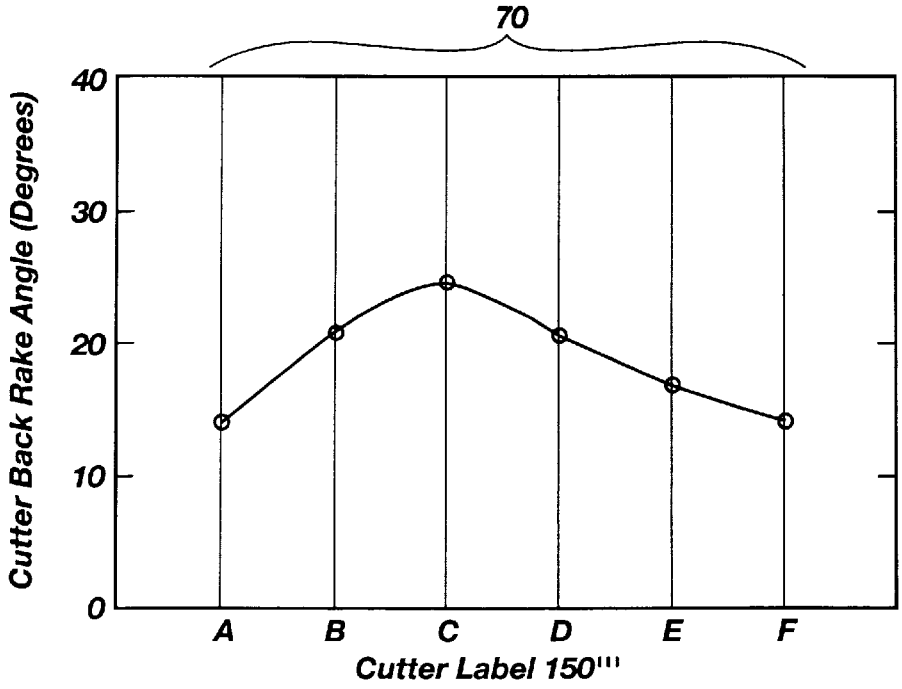
FIGS. 7B–7F graphically depict the relationships between the vertical positions of the cutters on the blade shown in FIG. 7A and the rake angles of each of these cutters.
Figure 7C:
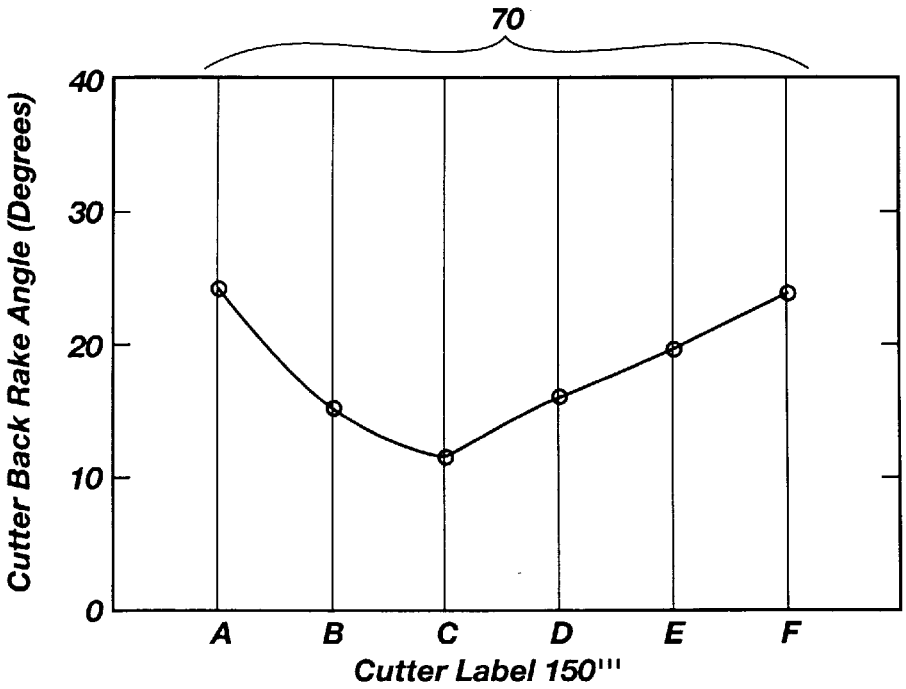
Figure 7D:
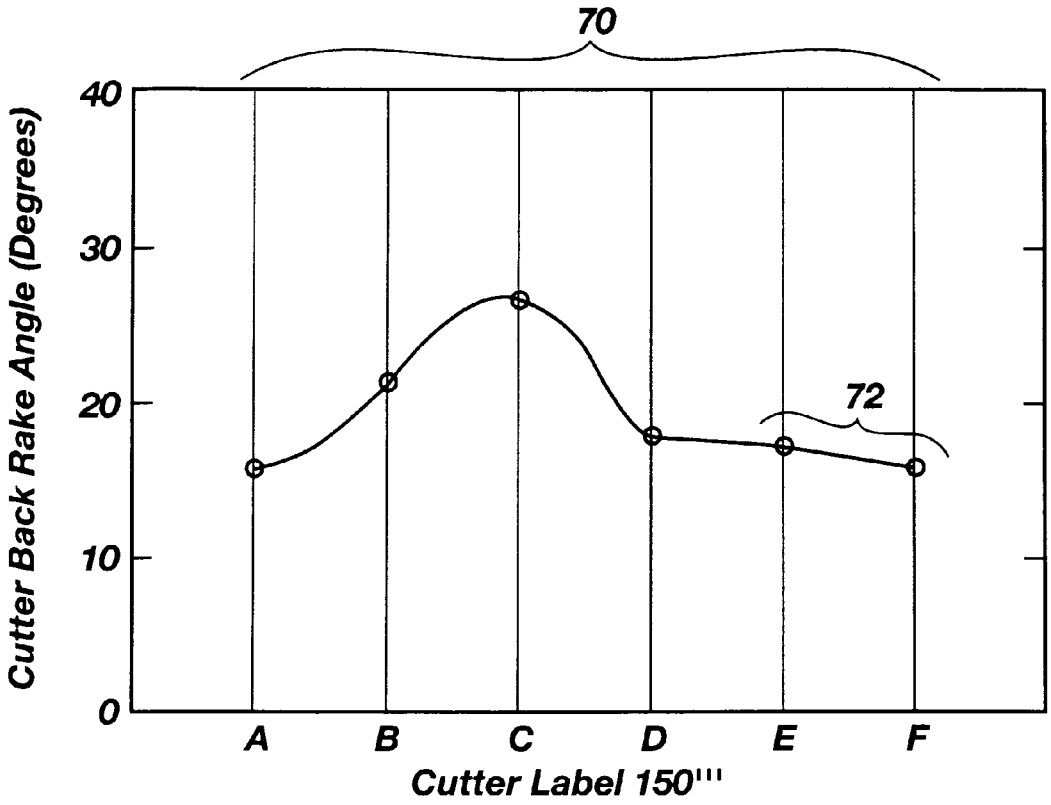
Figure 7E:
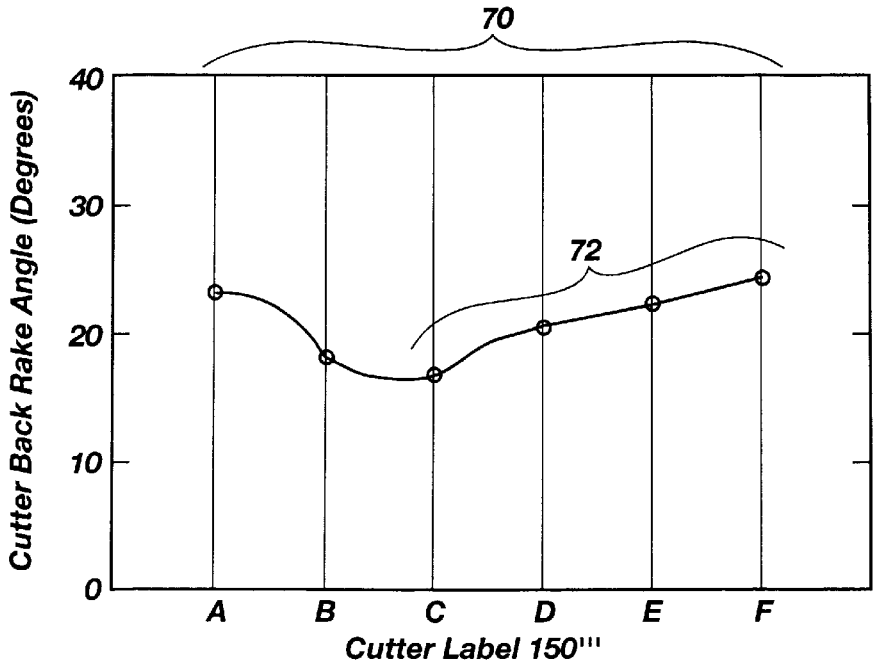
Figure 7F:
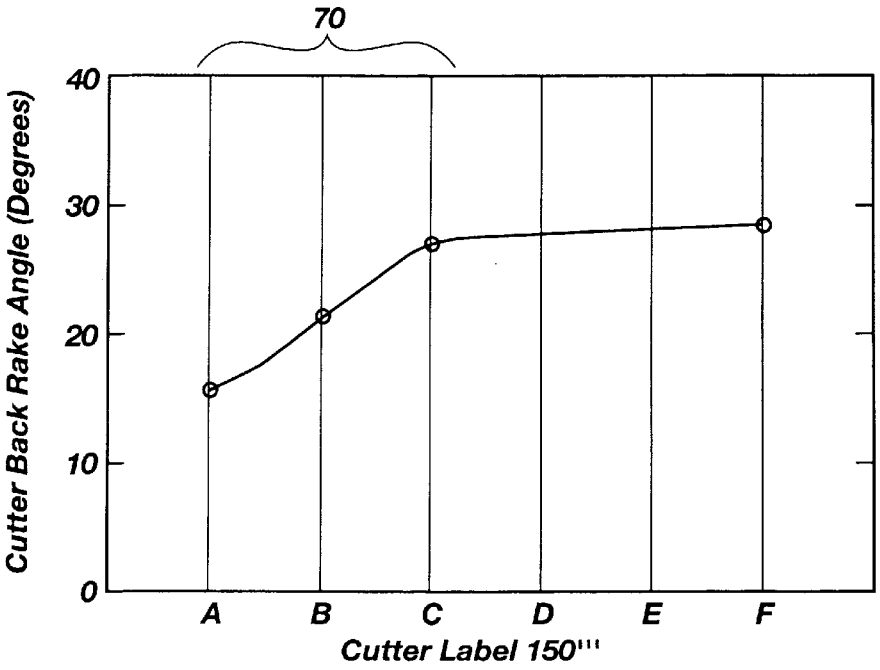

FIG. 7A depicts a blade 20'" of a drag bit 10'" that carries cutters 150A'"–150F'". In this embodiment, the rake angles 40 of the cutting faces 160'" of cutters 150A'"–150F'" are at least partially determined as a function of the vertical position of each cutter 150A'"–150F'" on a single blade 20'" relative to a longitudinal axis 44'" of drag bit 10'". Thus, the rake angles 40 of cutting faces 160'" are independent of the positioning of cutters on other blades of drag bit 10'". While rake angles 40 of the present embodiment are at least partially dependent upon the vertical locations of cutters 150A'"–150F'", the sequence of identification of cutters 150A'"–150F'" is based on the relative distance each of cutters 150A'"–150F'" on blade 20'" is radially spaced from longitudinal axis 44'".

Various exemplary rake angle 40 arrangements of cutters 150A'"–150F'" are illustrated in the graphs of FIGS. 7B–7F. As shown in FIGS. 7B–7F, in each of these rake angle 40 arrangements, sequentially positioned cutters 150'" on at least a portion of blade 20'", which is referred to as region 70, are oriented with their cutting faces 160'" at different, continuously varying rake angles 40. Where appropriate, regions 72 of a blade 20'" are designated in which at least two sequentially adjacent cutters 150'" have cutting faces 160'" that are oriented at different rake angles that vary by less than about five degrees.

As aforementioned, rake angles 40 of cutting faces 160 of cutters 150 may be advantageously designed to improve the individual wear characteristics of a cutter at one or more positions on a face 12 of a drag bit 10 or the overall wear characteristics of drag bit 10. In so designing a drag bit 10, wear data may be collected, either from worn drag bits, computer simulations, or extrapolation of laboratory data. Then, upon analysis of the wear data, the rake angles 40 at which cutting faces 160 of cutters 150 on the bit may be modified to adjust the relative wear of one or more cutters 150 or of the entire drag bit 10 so as to extend the useful life of cutters 150 or of drag bit 10.

Figure 8:
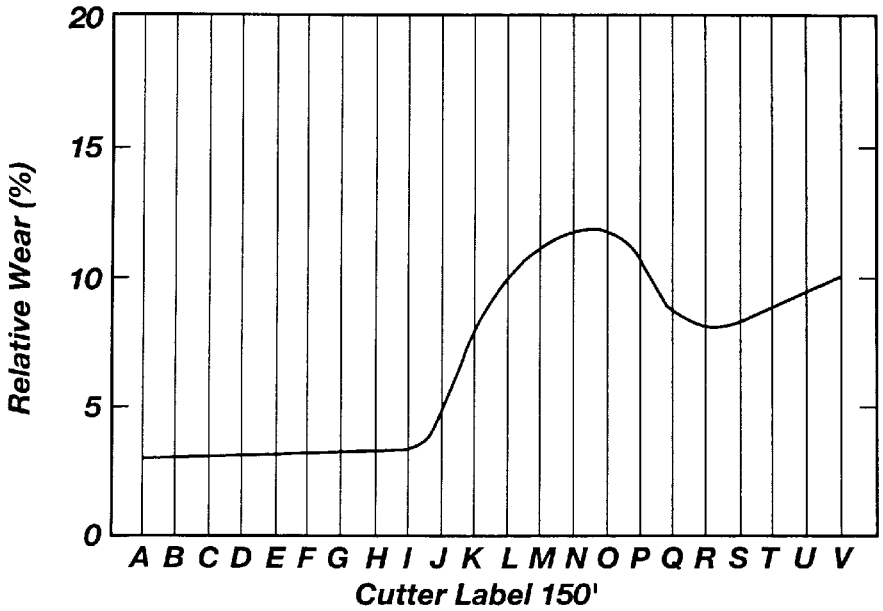
FIG. 8 graphically depicts the amount of wear exhibited by each of the cutters of the drag bit that is schematically represented in FIG. 5A.
Figure 9A:
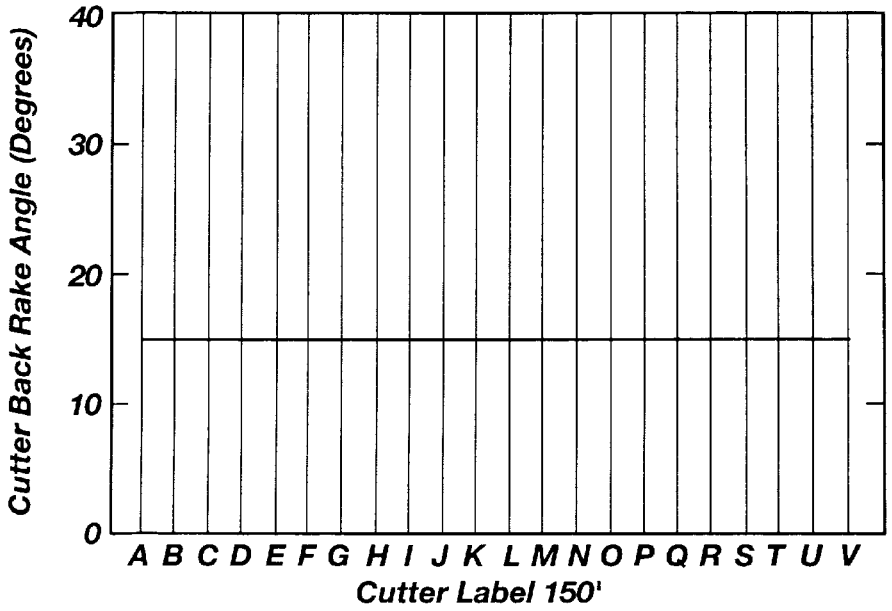
FIG. 9A graphically illustrates that the cutters of the drag bit of FIG. 5A have cutting faces oriented at substantially the same backrake angles.

For illustration purposes only, FIG. 8 depicts an example of the relative wear of cutters 150A'–150V' of drag bit 10' illustrated in FIG. 5A. Each of cutters 150A'–150V' was oriented with its cutting face 160' having a negative rake angle 40, or backrake, of about 15°, as depicted in the graph of FIG. 9A. The observed performance of individual cutters 150' or of the entire drag bit 10' is compared to desired performance criteria. The orientations of cutters 150' on drag bit 10' may then be modified to provide regions on drag bit 10' where sequentially adjacent cutters 150' have cutting faces 160' that have rake angles 40 that vary continuously so as to compensate for disparities between the desired and measured performance of cutters 150' or of drag bit 10'.

Figure 9B:
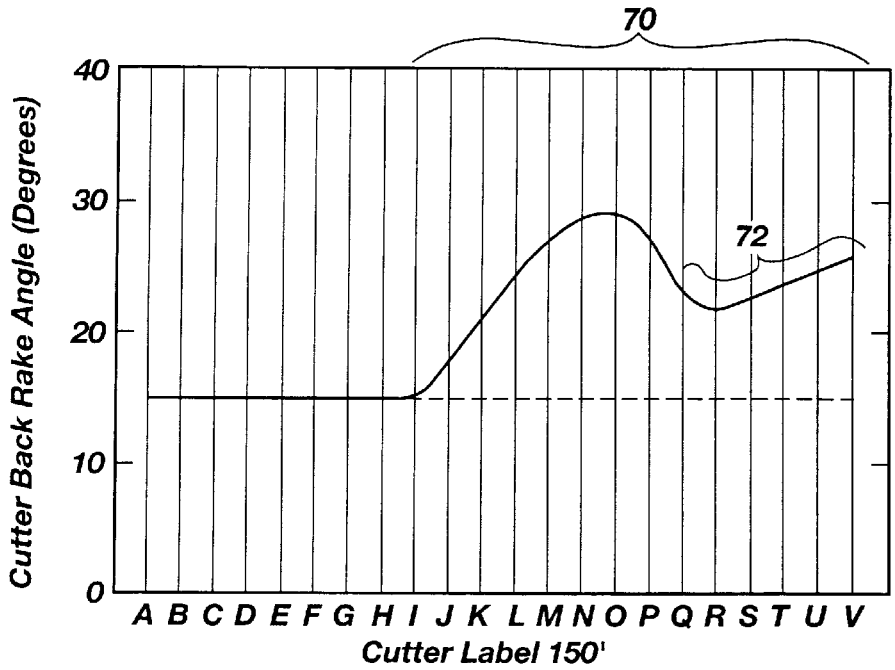
FIGS. 9B and 9C graphically depict reorientation of the cutters of the drag bit of FIG. 5A in response to the wear data shown in FIG. 9A.

As an example of a response to the observed wear data, cutters 150' that were subject to increased wear (e.g., cutters 150I'–150V') may be reoriented, as shown in the graph of FIG. 9B, so as to decrease the wear thereof, with cutting faces 160' of these cutters 150' (e.g. cutters 150I'–150V') oriented at rake angles 40 that will counteract the tendencies of cutters 150' in these locations to wear at increased rates relative to the wear rates of cutters 150' at other positions on drag bit 10'. In FIG. 9B, the rake angles 40 of cutting faces 160' of cutters 150A'–150H', which FIG. 8 shows exhibited very little wear (less than about five percent), were not changed, while the negativity of the rake angles 40 of cutting faces 160' of the remaining cutters 150I'–150V' was increased with the increased amount of wear illustrated in FIG. 8.

Figure 9C:
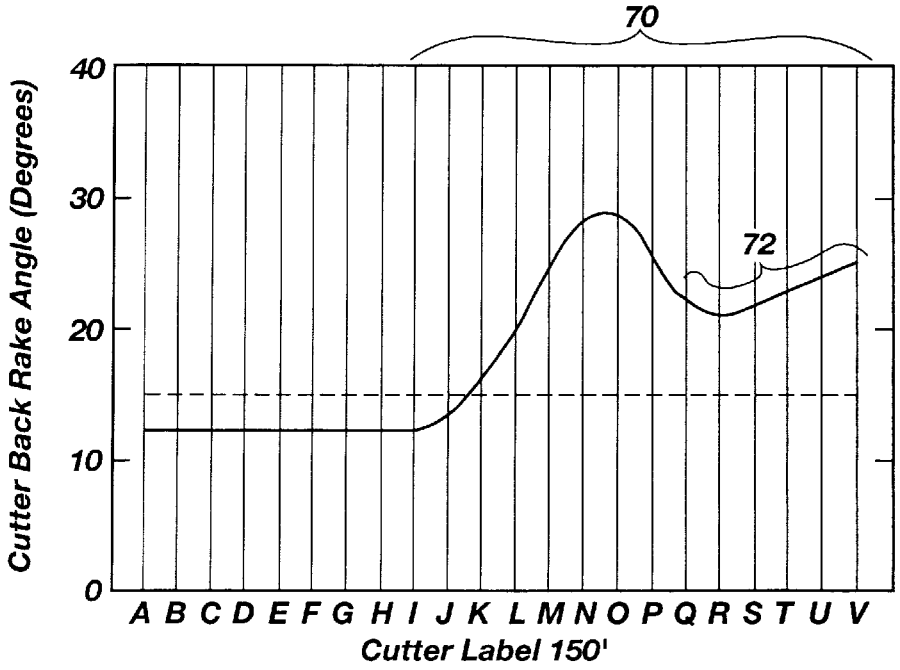

Alternatively, as depicted in FIG. 9C, rake angles 40 may be modified by reducing the negativity of rake angle 40 for the cutting faces 160' of cutters 150A'–150H', which exhibit low wear, and increasing the negativity of rake angles 40 for the cutting faces 160' of cutters 150I'–150V' in the higher wear areas of face 12' of drag bit 10'. One motivation for this strategy would be to prevent the weight on bit from increasing excessively due to the average increase in the negativity of rake angle 40 (i.e., backrake) of cutters 150'.

In this embodiment of the invention, FIGS. 9B and 9C depict modification of rake angles 40 in a manner that generally follows the wear pattern function. The modifications depicted in FIGS. 9B and 9C are not intended to limit the scope of the invention; rather, these modifications are only provided as exemplary embodiments of the invention.

Although most evident from the graphical representations of FIGS. 6B–6E, mathematical functions may be used to continuously vary the rake angles 40 of the cutting faces 160, 160', 160", 160'" of at least some cutters 150, 150', 150", 150'" carried upon the face 12, 12', 12", 12'" of a drag bit 10, 10', 10", 10'". For example, mathematical functions may be employed to generally increase or generally decrease the rake angles 40 of cutters 150, 150', 150", 150'" within such a variable region 70, depending upon the relative positions of these cutters 150, 150', 150", 150'". Linear functions or nonlinear functions may also be employed to arrange cutters 150, 150', 150", 150'" within a region 70 on the face 12, 12', 12", 12'" of a drag bit 10, 10', 10", 10'" so that the cutting faces 160, 160', 160", 160'" thereof are oriented at continuously varying rake angles 40. Likewise, polynomials, exponential functions, or cyclic functions may be employed to determine rake angles 40. The continuously varied rake angles 40 of the cutting faces 160, 160', 160", 160'" of cutters 150, 150', 150", 150'" sequentially positioned on at least a region 70 of a face 12, 12', 12", 12'" of a drag bit 10, 10', 10", 10'" may alternatively take the form of repeating or nonrepeating patterns.

Each of the herein-described inventive rake angle 40 arrangements of cutters 150, 150', 150", 150'" may include providing small changes (i.e., less than about 5°) in the rake angles 40 of cutting faces 160, 160', 160", 160'" of sequentially adjacent cutters 150, 150', 150", 150'" so as to smooth the transition between regions on face 12, 12', 12", 12'" with cutters 150, 150', 150", 150'" of different rake angles 40. By continuously varying the cutter backrake angle, several advantages will be apparent. One advantage of the continuous transition between different cutter backrake angles is smoothing the cutter forces between two areas with differing cutter backrake angles. These cutter forces directly affect bit whirling and the dynamic behavior of the bit. Thus, a smooth transition provides the advantage of smooth and more stable drilling. The reduction of vibration and dynamic loading extends cutter life, thereby extending the bit life as well. Another advantage is that, by varying the backrake angle, drilling performance and wear characteristics can be tailored.

As yet another alternative, a drill bit incorporating teachings of the present invention may include cutters with rake angles that continuously vary in a randomly generated manner. For example, the rake angles of the cutters of such a drill bit could be determined by a random number generator, as known in the art, rather than as a function of the radial or axial location of each cutter on the bit. Random rake angles may, for example, be useful for imparting the bit with increased stability or a desired amount of cuttings generation.

Many additions, deletions, and modifications may be made to the preferred embodiments of the invention as disclosed herein without departing from the scope of the invention as hereinafter claimed.

What is claimed is:

1. A drag bit for drilling a subterranean formation, comprising:

a bit body including a longitudinal axis, a gage distanced substantially radially from said longitudinal axis, and a face to be oriented toward the subterranean formation during drilling; and a plurality of cutters disposed over said face, at least one region of said face including a first cutter with a first rake angle, a second cutter with a second rake angle, and a third cutter with a third rake angle, said first, second, and third rake angles differing from one another, each of said first, second, and third rake angles being a function of at least one of a radial distance of said first, second, and third cutters from said longitudinal axis and a vertical position of said first, second, and third cutters along said longitudinal axis.

2. The drag bit of claim 1, wherein said first, second, and third rake angles differ in a manner to counteract different cutter wear rates at locations of said first, second and third cutters.

3. The drag bit of claim 1, wherein said first, second, and third cutters are sequential with respect to radial distances of said plurality of cutters from said longitudinal axis.

4. The drag bit of claim 1, wherein said bit body includes a plurality of blades.

5. The drag bit of claim 4, wherein said first, second, and third cutters are located on a same blade.

6. The drag bit of claim 4, wherein said first, second, and third cutters are located on different blades.

7. The drag bit of claim 1, wherein said first, second, and third rake angles are configured to reduce wear of said first, second, and third cutters.

8. The drag bit of claim 1, wherein said first, second, and third rake angles are configured to reduce thermal loading of said first, second, and third cutters.

9. The drag bit of claim 1, wherein said first, second, and third rake angles are configured to increase stability of the drag bit during drilling.

10. The drag bit of claim 1, wherein said first, second, and third rake angles are configured to improve a directional drilling characteristic of the drag bit.

11. The drag bit of claim 1, wherein said first, second, and third rake angles are configured to reduce bore hole stresses on said first, second, and third cutters.

12. A drag bit for drilling subterranean formations, comprising:

a bit body including a longitudinal axis, a bit gage distanced substantially radially from said longitudinal axis, and a face positioned to lead the drag bit into the subterranean formation during drilling; and a plurality of cutters oriented over said bit body, a rake angle of each cutter of said plurality of cutters being a function of at least one of a radial distance of said cutter from said longitudinal axis and a vertical position of said cutter along said longitudinal axis.

13. The drag bit of claim 12, wherein at least two cutters positioned on at least said face have different rake angles.

14. The drag bit of claim 12, wherein said plurality of cutters are sequential with respect to radial distances of said plurality of cutters from said longitudinal axis.

15. The drag bit of claim 14, wherein at least three sequential cutters of said plurality of cutters each have different rake angles than a rake angle of a sequentially adjacent cutter.

16. The drag bit of claim 12, wherein said plurality of cutters are sequential with respect to vertical positions of said plurality of cutters along said longitudinal axis.

17. The drag bit of claim 12, further comprising a plurality of blades.

18. The drag bit of claim 17, wherein at least two cutters positioned on one blade of said plurality of blades have different rake angles.

19. The drag bit of claim 12, wherein rake angles of said plurality of cutters are configured to reduce wear of at least some cutters of said plurality of cutters.

20. The drag bit of claim 12, wherein rake angles of said plurality of cutters are configured to reduce thermal loading of at least some cutters of said plurality of cutters.

21. The drag bit of claim 12, wherein at least some cutters of said plurality of cutters have rake angles that are configured to facilitate directional drilling with the drag bit.

22. The drag bit of claim 12, wherein at least some cutters of said plurality of cutters have rake angles that are configured to reduce bore hole stresses on said at least some cutters.

23. A drag bit for drilling a subterranean formation, comprising:

a bit body including a longitudinal axis, a gage distanced substantially radially from said longitudinal axis, and a face to be oriented toward the subterranean formation during drilling; and a plurality of cutters disposed over said face, at least one region of said face including a first cutter with a first rake angle and a second cutter with a second rake angle, said first and second rake angles varying by less than about five degrees and being a function of a radial distance of said first and second cutters from said longitudinal axis.

24. The drag bit of claim 23, wherein said first and second rake angles are also a function of a vertical position of said first and second cutters along said longitudinal axis.

25. The drag bit of claim 23, wherein said first and second rake angles differ in a manner to counteract different cutter wear rates at locations of said first and second cutters.

26. The drag bit of claim 23, wherein said first and second cutters are sequential with respect to radial distances of said plurality of cutters from said longitudinal axis.

27. The drag bit of claim 23, wherein said bit body includes a plurality of blades.

28. The drag bit of claim 27, wherein said first and second cutters are located on a same blade.

29. The drag bit of claim 27, wherein said first and second cutters are located on different blades.

30. The drag bit of claim 23, wherein said first and second rake angles are configured to perform a function comprising at least one of reducing wear of said first and second cutters, reducing thermal loading of said first and second cutters, increasing stability of the drag bit during drilling, improving a directional drilling characteristic of the drag bit, and reducing bore hole stresses on said first and second cutters.

31. A drag bit for drilling a subterranean formation, comprising:

a bit body including a longitudinal axis, a gage distanced substantially radially from said longitudinal axis, and a face to be oriented toward the subterranean formation during drilling; and a plurality of cutters disposed over said face, at least one region of said face including a first cutter with a first rake angle and a second cutter with a second rake angle, said first and second take angles varying by less than about five degrees and being a function of a vertical position of said first and second cutters along said longitudinal axis.

32. The drag bit of claim 31, wherein said first and second rake angles are also a function of a radial distance of said first and second cutters from said longitudinal axis.

33. The drag bit of claim 31, wherein said first and second rake angles differ in a manner to counteract different cutter wear rates at locations of said first and second cutters.

34. The drag bit of claim 31, wherein said first and second cutters are sequential with respect to radial distances of said plurality of cutters from said longitudinal axis.

35. The drag bit of claim 31, wherein said bit body includes a plurality of blades.

36. The drag bit of claim 35, wherein said first and second cutters are located on a same blade.

37. The drag bit of claim 35, wherein said first and second cutters are located on different blades.

38. The drag bit of claim 31, wherein said first and second rake angles are configured to perform a function comprising at least one of reducing wear of said first and second cutters, reducing thermal loading of said first and second cutters, increasing stability of the drag bit during drilling, improving a directional drilling characteristic of the drag bit, and reducing bore hole stresses on said first and second cutters.

39. A drag bit for drilling a subterranean formation, comprising:

bit body including a longitudinal axis, a gage distanced substantially radially from said longitudinal axis, and a face to be oriented toward the subterranean formation during drilling, and a plurality of cutters disposed over said face, at least one region of said face including a first cutter with a first rake angle and a second cutter with a second rake angle, said first and second cutters being sequential with respect to radial distances of said plurality of cutters from said longitudinal axis, said first and second rake angles varying by less than about five degrees.

40. The drag bit of claim 39, wherein said first and second rake angles are also a function of a radial distance of said first and second cutters from said longitudinal axis.

41. The drag bit of claim 39, wherein said first and second rake angles differ in a manner to counteract different cutter wear rates at locations of said first and second cutters.

42. The drag bit of claim 39, wherein said first and second rake angles are a function of a vertical position of said first and second cutters along said longitudinal axis.

43. The drag bit of claim 39, wherein said bit body includes a plurality of blades.

44. The drag bit of claim 43, wherein said first and second cutters are located on a same blade.

45. The drag bit of claim 43, wherein said first and second cutters are located on different blades.

46. The drag bit of claim 39, wherein said first and second rake angles are configured to perform a function comprising at least one of reducing wear of said first and second cutter, reducing thermal loading of said first and second cutters, increasing stability of the drag bit during drilling, improving a directional drilling characteristic of the drag bit, and reducing bore hole stresses on said first and second cutters.

* * * * *

UNITED STATES PATENT AND TRADEMARK OFFICE

CERTIFICATE OF CORRECTION

PATENT NO. : 6,536,543 B2 
DATED : March 25, 2003
INVENTOR(S) : Matthew J. Meiners, Jeffrey B. Lund and Thomas M. Harris It is certified that error appears in the above-identified patent and that said Letters Patent is hereby corrected as shown below:

Column 7,
Line 55, change "150IH" to -- 150H --

Column 14,
Line 25, change the comma after "drilling" to a semicolon
Line 50, change "cutter" to -- cutters --

Signed and Sealed this

Eighth Day of July, 2003

JAMES E. ROGAN
*Director of the United States Patent and Trademark Office*